US011255005B2

(12) United States Patent
Maeda et al.

(10) Patent No.: US 11,255,005 B2
(45) Date of Patent: Feb. 22, 2022

(54) HOT-ROLLED STEEL SHEET

(71) Applicant: NIPPON STEEL & SUMITOMO METAL CORPORATION, Tokyo (JP)

(72) Inventors: Daisuke Maeda, Tokyo (JP); Hiroshi Shuto, Tokyo (JP); Kazuya Ootsuka, Tokyo (JP); Akifumi Sakakibara, Tokyo (JP); Shinsuke Kai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 554 days.

(21) Appl. No.: 16/325,574

(22) PCT Filed: Aug. 18, 2016

(86) PCT No.: PCT/JP2016/074133

§ 371 (c)(1),
(2) Date: Feb. 14, 2019

(87) PCT Pub. No.: WO2018/033990

PCT Pub. Date: Feb. 22, 2018

(65) Prior Publication Data

US 2019/0177822 A1 Jun. 13, 2019

(51) Int. Cl.
*C22C 38/28* (2006.01)
*C22C 38/22* (2006.01)
(Continued)

(52) U.S. Cl.
CPC ..... *C22C 38/28* (2013.01); *C21D 8/0205* (2013.01); *C21D 8/0226* (2013.01); *C21D 9/46* (2013.01);
(Continued)

(58) Field of Classification Search
CPC ..... C21D 9/46; C21D 9/48
See application file for complete search history.

(56) References Cited

U.S. PATENT DOCUMENTS

2014/0000769 A1 1/2014 Takahashi et al.
2014/0242415 A1 8/2014 Azuma et al.
(Continued)

FOREIGN PATENT DOCUMENTS

JP 11-92859 A 4/1999
JP 11-152544 A 6/1999
(Continued)

OTHER PUBLICATIONS

"Metallic materials—Tensile testing—Method of test at room temperature", JIS Z 2241, 2011, total 67 pages.
(Continued)

*Primary Examiner* — Anthony M Liang
(74) *Attorney, Agent, or Firm* — Birch, Stewart, Kolasch & Birch, LLP

(57) ABSTRACT

A hot-rolled steel sheet includes, by mass %, C: 0.030% or more and less than 0.075%, Si+Al: 0.08% to 0.40%, Mn: 0.5% to 2.0%, and Ti: 0.020% to 0.150%, and includes a microstructure having a ferrite and a martensite. The hot-rolled steel sheet includes a microstructure having, by area %, 90% to 98% of the ferrite, 2% to 10% of the martensite, 0% to 3% of a bainite, and 0% to 3% of a pearlite. In the martensite, the number proportion of martensite grains having a hardness of 10.0 GPa or more is 10% or less, and a ratio N1/N2 of the number N1 of martensite grains having a hardness of 8.0 GPa or more and less than 10.0 GPa to the number N2 of martensite grains having a hardness of less than 8.0 GPa is 0.8 to 1.2.

6 Claims, 2 Drawing Sheets

(51) Int. Cl.

| | |
|---|---|
| ***C22C 38/16*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| ***C21D 8/02*** | (2006.01) |
| ***C22C 38/58*** | (2006.01) |

(52) U.S. Cl.

CPC ..... *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/58* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2015/0203949 | A1 | 7/2015 | Yokoi et al. |
| 2017/0159149 | A1 | 6/2017 | Toyoda et al. |
| 2017/0253944 | A1 | 9/2017 | Sakakibara et al. |

FOREIGN PATENT DOCUMENTS

| | | | | |
|---|---|---|---|---|
| JP | 2003-89848 | A | | 3/2003 |
| JP | 2003-193190 | A | | 7/2003 |
| JP | 2004-143518 | A | | 5/2004 |
| JP | 2004-204326 | A | | 7/2004 |
| JP | 2004-211199 | A | | 7/2004 |
| JP | 2007-63668 | A | | 3/2007 |
| JP | 2007-302918 | A | | 11/2007 |
| JP | 2009-24227 | A | | 2/2009 |
| JP | 2010-70789 | A | | 4/2010 |
| JP | 2014-141703 | A | | 8/2014 |
| JP | 2014141703 | A | * | 8/2014 |
| TW | 201319266 | A1 | | 5/2013 |
| TW | 201425599 | A | | 7/2014 |
| WO | WO 2012/128228 | A1 | | 9/2012 |
| WO | WO 2015/181911 | A1 | | 12/2015 |
| WO | WO 2016/043273 | A1 | | 3/2016 |

OTHER PUBLICATIONS

"Test pieces for tensile test for metallic materials", JIS Z 2201, 1998, total 6 pages.

Abe et al., "Quantitative Correlation of Static Strengthening Mechanisms to Fatigue Property in Low and Medium Carbon Steels", Iron and Steel, 1984, vol. 70, No. 10, pp. 145-152.

International Search Report for PCT/JP2016/074133 dated Nov. 22, 2016.

Office Action for TW 105126365 dated Mar. 28, 2017.

Written Opinion of the International Searching Authority for PCT/JP2016/074133 (PCT/ISA/237) dated Nov. 22, 2016.

Yokoi et al., "Cyclic stress response and fatigue behavior of Cu added ferritic steels", Journal of Materials Science, 2001, vol. 36, pp. 5757-5758.

Extended European Search Report, dated Feb. 4, 2020, for corresponding European Application No. 16913518.3.

* cited by examiner

HOT-ROLLED STEEL SHEET

TECHNICAL FIELD OF THE INVENTION

The present invention relates to a hot-rolled steel sheet.

RELATED ART

In recent years, according to increasing global environmental consciousness, in the automotive field, reduction of carbon dioxide emissions and improvement of fuel consumption are needed. For example, for such a problem, reducing the weight of a vehicle body is extremely effective, and the weight of the vehicle body can be reduced by applying a high strength steel sheet to the vehicle body. Therefore, in order to reduce carbon dioxide emissions, there is a strong desire to replace a hot-rolled steel sheet of the related art with a high strength hot-rolled steel sheet having a higher strength.

Currently, high strength hot-rolled steel sheets having tensile strength of 440 to 590 MPa class are used for chassis components of a vehicle. However, when such a high strength hot-rolled steel sheet is applied to a vehicle member to reduce the weight of a member (a thickness of a member), the rigidity of the member decreases.

In addition, as load stress increases, fatigue properties of the member may decrease or the durability of the member may decrease in some cases.

Therefore, a structure capable of reducing the load stress and a stress concentration is applied to the member to increase the rigidity and the durability of the member. In this case, since a member having a complex shape is obtained by forming, extremely high formability is required for a hot-rolled steel sheet.

In press forming of chassis members, a plurality of processing such as burring processing, stretch flange processing, and elongation processing are carried out on the hot-rolled steel sheet, and workability corresponding to these processings is required for the hot-rolled steel sheet.

In general, burring workability and stretch flange workability are correlated with a hole expansion ratio which is measured in a hole expansion test. That is, by applying a high strength hot-rolled steel sheet excellent in elongation and hole expansibility to the chassis members, it is possible to achieve both a reduction of the weight of the member according to the reduction of a sheet thickness and an improvement of the rigidity of the member at the same time, and it is possible to further reduce carbon dioxide emissions.

In general, examples of a high strength hot-rolled steel sheet for chassis members include a Dual Phase Steel (hereinafter referred to as DP steel) mainly including ferrite and martensite. The DP steel has high strength and excellent elongation. However, in the DP steel, since a difference in strength between the ferrite and the martensite is large, strain or stress is concentrated in the ferrite in the vicinity of the martensite during forming, and cracks are initiated. Therefore, the hole expansibility of DP steel is low. Based on this finding, hot-rolled steel sheets in which the difference in strength between structures is reduced to increase the hole expansion ratio have been developed.

Patent Document 1 discloses a steel sheet mainly including bainite or bainitic ferrite and having high strength and excellent hole expansibility. Since this steel sheet has substantially a single structure, strain or stress is difficult to be concentrated and the hole expansion ratio is high. However, since this steel sheet is a single structure steel mainly including bainite or bainitic ferrite, elongation greatly deteriorates. Therefore. Patent Document 1 was not able to achieve both excellent elongation and excellent hole expansibility at the same time.

In recent years, a steel sheet which uses a ferrite excellent in elongation as a single structure and has strength enhanced by a carbide such as Ti and Mo has been proposed (for example. Patent Documents 2 to 4). However, the steel sheet disclosed in Patent Document 2 includes a large amount of Mo and the steel sheet disclosed in Patent Document 3 includes a large amount of V. Further, in the steel sheet disclosed in Patent Document 4, in order to refine grains, it is necessary to cool the steel sheet in the middle of rolling. Therefore, in the related art such as Patent Documents 2 to 4 alloy costs or manufacturing costs increase. In addition, in the steel sheets disclosed in Patent Documents 2 to 4, since strength of a ferrite itself is greatly enhanced, elongation deteriorates. The elongation of these steel sheets was higher than elongation of the steel having a single structure mainly including bainite or a bainitic ferrite. However, the balance between elongation and hole expansibility was not necessarily sufficient.

In addition, Patent Document 5 discloses a composite structure steel sheet which uses bainite instead of the martensite in the DP steel and enhances hole expansibility by reducing a difference in strength between a hard phase and a ferrite. Further, Patent Document 6 discloses a steel sheet which mainly includes a ferrite and a tempered martensite, and uses bainite to enhance strength. In this steel sheet, a difference in hardness between the tempered martensite and the ferrite is reduced to enhance the hole expansibility. However, in these Patent Documents 5 and 6, as a result of increasing an area ratio of bainite in order to secure strength, the elongation deteriorated and a balance between elongation and hole expansibility was not sufficient. In addition, in Patent Document 6, since cold rolling and subsequent annealing and cooling are necessary, production costs increase.

In the related art, for members requiring excellent fatigue strength, a steel sheet in which fatigue strength was enhanced by grain refinement strengthening and solid solution strengthening has been used.

For example, in Patent Documents 7 to 10, in order to obtain a steel sheet excellent in fatigue resistance, the grain refinement strengthening is applied. Specifically, Patent Documents 7 and 8 disclose a steel sheet in which an average ferrite grain size is reduced to smaller than 2 μm. Patent Document 9 discloses a steel sheet in which an average grain size of polygonal ferrites gradually decreases from a thickness center portion to a surface layer. In addition, Patent Document 10 discloses a steel sheet in which an average block size of martensite structure was reduced to 3 μm or less.

In addition, for example, Non-Patent Document 1 discloses that the fatigue limit increases as the yield stress increases in order of grain refinement strengthening, precipitation strengthening, and solid solution strengthening. Non-Patent Document 2 discloses that, when Cu in a steel changes from a solid solution (solute) to a precipitate, the fatigue limit ratio decreases. In this manner, as the precipitate increases, the solid solution (solute) decreases. Therefore, the amount of precipitate was limited such that fatigue strength can be enhanced as much as possible for members requiring excellent fatigue strength. As a result, for members requiring excellent fatigue strength, a steel sheet in which fatigue strength was enhanced by solid solution strengthening has been preferentially used.

PRIOR ART DOCUMENT

Patent Document

[Patent Document 1] Japanese Unexamined Patent Application, First Publication No. 2003-193190

[Patent Document 2] Japanese Unexamined Patent Application, First Publication No. 2003-089848
[Patent Document 3] Japanese Unexamined Patent Application, First Publication No. 2007-063668
[Patent Document 4] Japanese Unexamined Patent Application, First Publication No. 2004-143518
[Patent Document 5] Japanese Unexamined Patent Application, First Publication No. 2004-204326
[Patent Document 6] Japanese Unexamined Patent Application, First Publication No. 2007-302918
[Patent Document 7] Japanese Unexamined Patent Application, First Publication No. H11-92859
[Patent Document 8] Japanese Unexamined Patent Application, First Publication No. H11-152544
[Patent Document 9] Japanese Unexamined Patent Application, First Publication No. 2004-211199
[Patent Document 10] Japanese Unexamined Patent Application, First Publication No. 2010-70789

Non-Patent Document

[Non-Patent Document 1] Takashi Abe et al.: Iron and Steel, Vol. 70 (1984), No. 10, p. 145
[Non-Patent Document 2] T. Yokoi et al.: Journal of Materials Science, Vol. 36 (2001), p. 5757

DISCLOSURE OF THE INVENTION

Problems to be Solved by the Invention

The present invention has been made in view of the above-described problems, and an object of the present invention is to provide a high strength hot-rolled steel sheet excellent in strength, elongation, and hole expansibility. In addition, another object of the present invention is to provide a high strength hot-rolled steel sheet excellent in strength, elongation, hole expansibility, and fatigue strength.

Means for Solving the Problem

The present inventors conducted intensive studies on the influence of a chemical composition and a microstructure on elongation and the influence of the chemical composition and the microstructure on hole expansibility. As a result, the present inventors clarified that it is possible to enhance not only strength but also elongation and hole expansibility by optimizing a chemical composition, controlling a microstructure to mainly include ferrite and martensite, and mixing a hard martensite and a relatively soft martensite in the microstructure. Further, the present inventors clarified that, even when using a precipitate (Ti carbide) instead of a solid solution (solid solution C and solid solution Ti), it is possible to impart fatigue strength higher than fatigue strength obtained by solid solution strengthening to a steel sheet by using Ti carbide as a precipitate and controlling the grain sizes of the Ti carbide.

That is, summary of the present invention is as follows.

(1) According to an aspect of the present invention, there is provided a hot-rolled steel sheet including, as a chemical composition, by mass %, C: 0.030% or more and less than 0.075%, Si+Al: 0.08% to 0.40%, Mn: 0.5% to 2.0%, Ti: 0.020% to 0.150%, Nb: 0% to 0.06%, Mo: 0% to 1.0%, V: 0% to 1.00%, W: 0% to 1.0%, B: 0% to 0.005%, Cu: 0% to 1.2%, Ni: 0% to 0.80%, Cr: 0% to 1.5%, Ca: 0% to 0.005%, REM: 0% to 0.050%, P: 0% to 0.040%, S: 0% to 0.0100%, N: 0% to 0.0100%, and a remainder of Fe and impurities, in which the hot-rolled steel sheet includes a microstructure having a ferrite and a martensite, the microstructure includes 90% to 98% of the ferrite, 2% to 10% of the martensite, 0% to 3% of a bainite, and 0% to 3% of a pearlite, by area %, in the martensite, a number proportion of martensite grains having a hardness of 10.0 GPa or more is 10% or less, and a ratio N1/N2 of the number N1 of martensite grains having a hardness of 8.0 GPa or more and less than 10.0 GPa to the number N2 of martensite grains having a hardness of less than 8.0 GPa is 0.8 to 1.2.

(2) The hot-rolled steel sheet according to (1) may include, as the chemical composition, by mass %, at least one selected from the group consisting of Nb: 0.005% to 0.06%, Mo: 0.05% to 1.0%, V: 0.02% to 1.0%, W: 0.1% to 1.0%, B: 0.0001% to 0.005%, Cu: 0.1% to 1.2%, Ni: 0.05% to 0.8%, Cr: 0.01% to 1.5%, Ca: 0.0005% to 0.0050%, and REM: 0.0005% to 0.0500%.

(3) In the hot-rolled steel sheet according to (1) or (2), Ti existing as a Ti carbide may be, by mass %, 40% or more of Tief calculated by Equation (a).

$$Tief=[Ti]-48/14\times[N]-48/32\times[S] \quad (a)$$

(4) In the hot-rolled steel sheet according to (3), a ratio of a total mass of Ti carbide having a circle equivalent grain size of 7 nm to 20 nm to a total mass of all Ti carbides may be 50% or more.

Effects of the Invention

Since the hot-rolled steel sheet according to the aspects (1) to (4) of the present invention is not only high in strength but also excellent in elongation and hole expansibility, it is possible to easily perform forming on a member even in a case of requiring severe working. Therefore, the hot-rolled steel sheet according to this aspect can be widely applied to chassis members in a vehicle or other members requiring severe working. In addition, since a member obtained from the hot-rolled steel sheet according to this aspect has a high durability even at a small sheet thickness, a vehicle body weight can be remarkably reduced. Accordingly, the hot-rolled steel sheet according to this aspect effectively reduces the vehicle body weight through reduction of a sheet thickness. Therefore, carbon dioxide emissions can be remarkably reduced. Further, since the hot-rolled steel sheet according to the aspect (4) of the present invention has not only high strength and excellent elongation and hole expansibility but also excellent fatigue strength, it is also possible to extend the life of a member to which a strong cyclic load is applied. Therefore, the hot-rolled steel sheet of the aspect (4) can be suitably applied to more kinds of members than that of the hot-rolled steel sheet of the aspects (1) to (3).

EMBODIMENTS OF THE INVENTION

Figure 1:
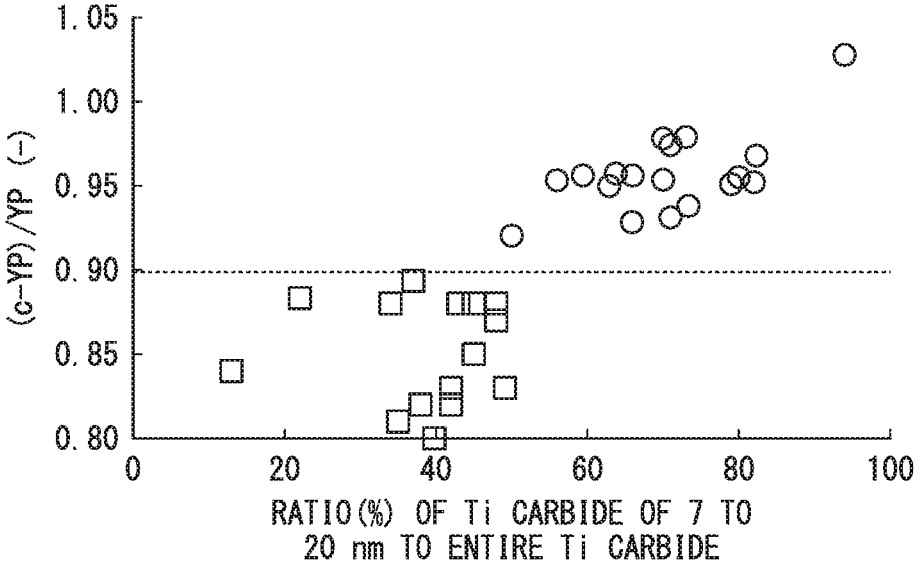
FIG. 1 is a diagram showing an example of a relationship between the ratio of Ti carbide of 7 to 20 nm to the entire Ti carbide and (c-YP)/YP.

First, results of examination by the present inventors and new findings obtained from the examination result will be described.

A DP steel is a steel sheet in which a martensite harder than a ferrite is dispersed in a soft ferrite, and has high elongation in addition to high strength. However, hole expansibility of the DP steel is extremely low. When the DP steel is deformed, strain or stress are concentrated in the DP steel due to a difference in strength between a ferrite and a martensite, and voids causing ductile fracture are likely to be formed. However, a mechanism forming voids has not been investigated in detail and the relationship between microstructure of the DP steel and ductile fracture was not necessarily clear.

The initiation and propagation of a crack in hole expansion work is caused by the ductile fracture in which formation, growth, and connection of voids are elementary processes.

Therefore, the present inventors investigated the mechanism of forming voids during working and hole expansibility in detail using DP steels having various structures. As a result, it was clarified that most of the voids that causes a DP steel to break by an increase (growth) and connection are formed by brittle fracture or ductile fracture of a martensite.

Further, the present inventors examined a relationship between an internal structure of a martensite and proneness to fracture of ferrites in the vicinity of the martensite, that is, proneness to void formation. As a result, the present inventors found that the proneness to void formation is strongly influenced by the internal structure of a martensite (the amount of solid solution carbon).

In addition, it was found that solid solution carbon existing in a supersaturated state in a martensite is likely to greatly increase strength of a martensite, while being likely to cause brittle fracture of the martensite. This solid solution carbon is a main factor for increasing the hardness of martensite. However, it is extremely difficult to directly and stably measure solid solution carbon. Therefore, in this study and in an embodiment to be described later, instead of the amount of the solid solution carbon in a martensite, the hardness of the martensite is regarded as an internal structure of martensite. When the hardness of martensite is 10.0 GPa or more, the martensite undergoes brittle fracture at very little strain in an nital stage of deformation to form voids. Therefore, martensite grain having a hardness of 10.0 GPa or more greatly inhibits the hole expansibility of a DP steel. Accordingly, in order to suppress void formation, softening martensite is effective.

In order to soften a martensite, it is effective to precipitate iron carbide by a heat treatment such as tempering and reduce the amount of solid solution carbon. However, a martensite, in which the amount of solid solution carbon was reduced by iron carbide precipitation, has low strength and lower the strength of a DP steel. In this case, in order to compensate for the lowered strength, it is necessary to increase the area ratio of martensite. However, when the area ratio of the martensite increases, the area ratio of ferrite having high ductility decreases. Therefore, the ductility of a DP steel decreases and elongation or hole expansibility is not sufficient.

Therefore, the present inventors intensively examined the microstructure which enhances all the strength, the elongation, and the hole expansibility at the same time. As a result, the present inventors clarified that it is possible to improve all the strength, the elongation, and the hole expansibility at the same time, by changing the internal structure of the martensite and controlling the amount of hard martensite and the amount of relatively soft martensite. The obtained findings will be described below.

The martensite grains (hard martensite) having a hardness of 8.0 GPa or more and less than 10.0 GPa greatly enhances the strength of a DP steel, but has deformability higher than that of the martensite grains (very hard martensite) having a hardness of 10.0 GPa or more and does not fracture brittle. Therefore, it is relatively difficult to form a void. However, the present inventors examined the DP steel in which the martensite is formed of only martensite grains having a hardness of 8.0 GPa or more and less than 10.0 GPa. As a result, the number of voids increased with the increase of the amount of deformation, and finally, it was not possible to obtain high hole expansibility due to a large amount of voids.

On the other hand, the martensite grain (relatively soft martensite) having a hardness of less than 8.0 GPa has a very high deformability, and even applying a high strain, the martensite does not break, and it is extremely difficult to form a void. Martensite grains having a hardness of less than 8.0 GPa also enhances the strength of a DP steel but the amount of an increase in strength is smaller than the amount of increase in strength due to the martensite grain with hardness of 8.0 GPa or more. Since martensite grains having a hardness of 8.0 GPa or more and less than 10.0 GPa cause voids to be formed, there is a possibility of degrading hole expansibility. However, if the amount of martensite grains having a hardness of 8.0 GPa or more and less than 10.0 GPa is limited to a certain amount or less, the amount of voids formed is small. Therefore, the hole expansibility hardly deteriorates. Therefore, when the amount of martensite grains having a hardness of 8.0 GPa or more and less than 10.0 GPa is increased to the extent that hole expansibility does not deteriorate greatly to enhance the strength of DP steel as much as possible, and the amount of martensite grains having a hardness of less than 8.0 GPa according to the amount of martensite grains having a hardness of 8.0 GPa or more and less than 10.0 GPa to further enhance the deformability is increased while maintaining the strength of DP steel, it is possible to achieve a DP steel with high strength, high hole expansibility, and high elongation. That is, when the ratio of the amount of the hard martensite to the amount of the relatively soft martensite is a desired ratio, it is possible to achieve high strength, high hole expansibility, and high elongation. In the embodiment to be described later, in order to enhance the strength, the martensite grains having a hardness of 8.0 GPa or more and less than 10.0 GPa are mainly used. However, since martensite grains having a hardness of 10.0 GPa or more is extremely likely to form voids, the amount of martensite grains having a hardness of 10.0 GPa or more is reduced as much as possible.

In addition, the present inventors also examined the fatigue properties of the steel sheet. When the ratio of cyclic yield stress (c-YP) to yield stress (YP) increases, low cycle characteristics and high cycle characteristics become more favorable. Therefore, in the embodiment described later, the ratio of the cyclic yield stress (c-YP) to the yield stress (YP) is defined as fatigue strength. Here, the cyclic yield stress (c-YP) means resistance to deformation after predetermined cyclic deformation to be described later, that is, resistance to fatigue. The present inventors found that when the ratio of the cyclic yield stress (c-YP) to the yield stress (YP) is 0.90 or more, since the resistance to fatigue is high even in low yield stress (YP), productivity during press forming can be increased without sacrificing fatigue properties of a steel sheet.

In addition, as described above, it is known that the amount of an increase in fatigue strength by precipitation strengthening is smaller than the amount of increase in fatigue strength by solid solution strengthening. However, the amount of increase in tensile strength by precipitation strengthening is greater than the amount of increase in tensile strength by solid solution strengthening. Therefore, the present inventors investigated in detail a method capable of enhancing the tensile strength without sacrificing fatigue strength by precipitation strengthening.

As a result, the present inventors found that when effectively utilizing Ti carbide having a circle equivalent grain size of 7 nm to 20 nm as a precipitate, even with precipitation strengthening, fatigue strength higher than fatigue strength obtained by solid solution strengthening can be imparted to a steel sheet, that is, the ratio of cyclic yield stress (c-YP) to yield stress (YP) can be increased to 0.90 or more.

The present inventors consider the reason why the Ti carbide having a circle equivalent grain size of 7 nm to 20 nm increase fatigue strength, as follows. When the Ti carbide have a circle equivalent grain sizes of 7 nm to 20 nm, dislocation circumvent the TI carbide to form a circular dislocation called Orowan loop around the Ti carbide. Each time dislocation traverses the Ti carbide, the Orowan loop grows and the dislocation density increases. As the cyclic deformation progresses, the dislocation density increases and the yield stress increases. Therefore, the fatigue strength is enhanced. On the other hand, when the Ti carbide has a circle equivalent grain size of smaller than 7 nm, dislocation shears the Ti carbide to pass through the Ti carbide. Therefore, during the cyclic deformation, movement of dislocation cannot be disturbed by the Ti carbide, the fatigue strength is lowered. In addition, when the Ti carbide has a circle equivalent grain size of larger than 20 nm, the number (density) of Ti carbide decreases. Therefore, during the cyclic deformation, movement of dislocation cannot be disturbed by the Ti carbide, the fatigue strength is lowered.

Accordingly, it is important to increase the amount of the Ti carbide by bonding solid solution Ti with C as much as possible and increase the ratio of the Ti carbide having a circle equivalent grain size of 7 nm to 20 nm to the entire Ti carbide, in order to enhance the fatigue strength.

Hereinafter, a hot-rolled steel sheet according to an embodiment of the present invention will be described.

First, a chemical composition of the hot-rolled steel sheet according to the present embodiment will be described in detail. The sign "%" of the amount of each element means mass %.

(C: 0.030% or more and less than 0.075%)

C is an important element to form a martensite. In addition, C can be bonded with Ti to form Ti carbide which enhances strength of ferrite. In order to form the martensite sufficiently, the amount of C needs to be 0.030% or more. The amount of C is preferably 0.035% or more or 0.040% or more. However, when the amount of C is 0.075% or more, the amount of martensite is too large and the hole expansibility deteriorates. Therefore, the amount of C needs to be less than 0.075%. The amount of C is preferably 0.070% or less, 0.065% or less, or 0.060% or less.

(Mn: 0.5% to 2.0%)

Mn is an important element that enhances strength and hardenability of ferrite. In order to enhance the hardenability and form the martensite, the amount of Mn needs to be 0.5% or more. The amount of Mn is preferably 0.6% or more, 0.7% or more, or 0.8% or more, and more preferably 0.9% or more or 1.0% or more. However, when the amount of Mn exceeds 2.0%, ferrite cannot be formed sufficiently. Therefore, the upper limit of the amount of Mn is 2.0%. The amount of Mn is preferably 1.9% or less, 1.8% or less, 1.7% or less, or 1.6% or less, and more preferably 1.5% or less or 1.4% or less.

(P: 0% to 0.040%)

P is an impurity element. When the P exceeds 0.040%, weld is remarkably brittle. Therefore, the amount of P is limited to 0.040% or less. The amount of P is preferably 0.030% or less of 0.020% or less, and more preferably 0.015% or less. A lower limit of the amount of P is not particularly determined, but reducing the amount of P to less than 0.0001% is economically disadvantageous. Therefore, from the viewpoint of manufacturing costs, it is preferable to set the amount of P to 0.0001% or more.

(S: 0% to 0.0100%)

S is an impurity element. Since the S adversely affects weldability, castability, and manufacturability during hot rolling, the amount of S is limited to 0.0100% or less. In addition, when steel contains excessive S, coarse MnS is formed and the hole expansibility deteriorates. Therefore, in order to improve the hole expansibility, it is preferable to reduce the amount of S. From such a viewpoint, the amount of S is preferably 0.0060% or less or 0.0050% or less, and more preferably 0.0040% or less. The lower limit of S is not particularly determined, but reducing the amount of S to less than 0.0001% is economically disadvantageous. Therefore, it is preferable to set the amount of S to 0.0001% or more.

(Si+Al: 0.08% to 0.40%)

Si and Al are important elements that affect strengthening of ferrite, formation of ferrite, and strength through carbide precipitation in the martensite. In order to form the ferrite to 90 area % or more, the total amount of Si and Al needs to be 0.08% or more. In order to further increase the amount of the ferrite, the total amount of Si and Al is preferably 0.20% or more and more preferably 0.30% or more. On the other hand, when the total amount of Si and Al exceeds 0.40%, precipitation of iron carbide in the martensite is suppressed. Therefore, the number of martensite grains having a hardness of less than 8 GPa decreases. (N1/N2) to be described later exceeds 1.2, and the hole expansibility decreases. Accordingly, the total amount of Si and Al is 0.40% or less. In order to further enhance the hole expansibility, the total amount of Si and Al is preferably 0.30% or less and more preferably 0.20% or less. As above, it is important to set the total amount of Si and Al within a range of 0.08% to 0.40%. In the case of reducing the steelmaking costs, the amount of Si is preferably 0.05% or more, and the amount of Al is preferably 0.03% or more. From the above, the amount of Si needs to be 0.40% or less, and is preferably 0.37% or less. In addition, the amount of Al needs to be 0.40% or less, and is preferably 0.35% or less. In addition, in order to improve the surface properties of the steel sheet, the amount of Si is preferably 0.20% or less, and the amount of Al is preferably 0.10% or less.

(N: 0% to 0.0100%)

N is an impurity element. When the amount of N exceeds 0.0100%, coarse nitrides are formed and bendability and hole expansibility deteriorate. Therefore, the amount of N is limited to 0.0100% or less. In addition, when the amount of N increases, the probability of forming blowholes during welding increases. Therefore, it is preferable to reduce the amount of N. From such a viewpoint, the amount of N is preferably 0.0090% or less, 0.0080% or less, or 0.0070% or less, and more preferably 0.0060% or less, 0.0050% or less, or 0.0040% or less. The lower limit of the amount of N is not particularly determined, but manufacturing costs increase greatly for setting the amount of N to less than 0.0005%. Therefore, it is preferable to set the amount of N to 0.0005% or more.

(Ti: 0.020% to 0.150%)

Ti is an important element that forms a carbide and strengthens a ferrite. When the amount of Ti falls below 0.020%, strength of the ferrite is not sufficient. Therefore, the strength of a steel sheet is insufficient. When the area ratio of the martensite is increased to compensate for the insufficient strength, the elongation deteriorates. Therefore, the amount of Ti needs to be 0.020% or more. In order to further strengthen the ferrite, the amount of Ti is preferably 0.030% or more and more preferably 0.040% or more. In particular, in order to enhance the tensile strength preferentially, it is particularly preferable to set the amount of Ti to 0.070% or more, 0.080% or more, 0.090% or more, or 0.100% or more. On the other hand, when the amount of Ti exceeds 0.150%, the ferrite is strengthened excessively to greatly deteriorate the elongation. Therefore, the amount of Ti is limited to 0.150% or less. The amount of Ti is preferably 0.140% or less or 0.130% or less. In particular, in order to maintain the elongation as much as possible, the amount of Ti is preferably less than 0.070% or 0.060% or less.

The hot-rolled steel sheet according to the present embodiment includes, as basic chemical composition, the above elements (essential elements), impurities (impurity element), and Fe of a remainder. The hot-rolled steel sheet according to the present embodiment may further include the following elements (optional elements). That is, some of Fe of the remainder in the basic chemical composition can be replaced with at least one selected from the group consisting of 0% to 0.06% of Nb, 0% to 1.0% of Mo, 0% to 1.00% of V, 0% to 1.0% of W, 0% to 0.005% of B, 0% to 1.2% of Cu, 0% to 0.80% of Ni, 0% to 1.5% of Cr, 0% to 0.005% of Ca, and 0% to 0.050% of REM.

In the hot-rolled steel sheet according to the present embodiment, the amount of Nb may also be 0% to 0.06%.

(Nb: 0% to 0.06%)

Nb is an element related to precipitation strengthening of the ferrite. When the amount of Nb exceeds 0.06%, a starting temperature or speed of ferritic transformation greatly lowered and the ferritic transformation does not proceed sufficiently. Therefore, the elongation deteriorates. Therefore, from such a viewpoint, the amount of Nb is preferably 0.06% or less, and more preferably 0.05% or less, 0.04% or less, 0.03% or less, or 0.02% or less. In order to strengthen ferrite, the amount of Nb is preferably 0.005% or more and more preferably 0.010% or more. Even when the amount of Nb is less than 0.005%, Nb does not adversely affect the steel sheet characteristics. Therefore, the amount of Nb may be 0%, and may also be less than 0.005%.

The hot-rolled steel sheet according to the present embodiment may include at least one selected from the group consisting of 0% to 1.0% of Mo, 0% to 1.00% of V, and 0% to 1.0% of W. That is, in the hot-rolled steel sheet according to the present embodiment, the amount of Mo may be 0% to 1.0%, the amount of V may be 0% to 1.00%, and the amount of W may be 0% to 1.0%.

(V: 0% to 1.00%, W: 0% to 1.0%, Mo: 0% to 1.0%)

V, Mo, and W are elements that enhance the strength of the steel sheet. In order to further enhance the strength of the steel sheet, the steel sheet preferably include at least one selected from the group consisting of 0.02% to 1.00% of V, 0.05% to 1.0% of Mo, and 0.1% to 1.0% of W. Even when the amount of V is less than 0.02%, the amount of Mo is less than 0.05% and the amount of W is less than 0.1%, V, Mo, and W do not adversely affect the steel sheet characteristics. Therefore, the amount of V may be 0%, and may also be less than 0.02%. In addition, the amount of Mo may be 0%, and may also be less than 0.05%. The amount of W may be 0%, and may also be less than 0.1%. However, when the amount of V, the amount of Mo, and the amount of W are excessive, formability may deteriorate in some cases. Therefore, the amount of V is preferably 1.00% or less, the amount of W is preferably 1.0% or less, and the amount of Mo is 1.0% or less.

The hot-rolled steel sheet according to the present embodiment may include at least one selected from the group consisting of 0% to 0.005% of B, 0% to 1.2% of Cu, 0% to 0.80% of Ni, and 0% to 1.5% of Cr. That is, in the hot-rolled steel sheet according to the present embodiment, the amount of B may be 0% to 0.005%, the amount of Cu may be 0% to 1.2%, the amount of Ni may be 0% to 0.80%, and the amount of Cr may be 0% to 1.5%.

(Cr: 0% to 1.5%, Cu: 0% to 1.2%, Ni: 0% to 0.80%, B: 0% to 0.005%)

Further, in order to enhance the strength of the steel sheet, the steel sheet may further include at least one selected from the group consisting of 0.01% to 1.5% of Cr, 0.1% to 1.2% of Cu, 0.05% to 0.80% of Ni, and 0.0001% to 0.005% of B. Even when the amount of Cr is less than 0.01%, the amount of Cu is less than 0.1%, the amount of Ni is less than 0.05%, and the amount of B is less than 0.0001%, Cr, Cu, Ni, and B do not adversely affect the steel sheet characteristics. Therefore, the amount of Cr may be 0%, and may also be less than 0.01%. In addition, the amount of Cu may be 0%, and may also be less than 0.1%. The amount of Ni may be 0%, and may also be less than 0.05%. The amount of B may be 0%, and may also be less than 0.0001%. However, when the amount of Cr, the amount of Cu, the amount of Ni, and the amount of B are excessive, formability may deteriorate in some cases. Therefore, the amount of Cr is preferably 1.5% or less, the amount of Cu is preferably 1.2% or less, the amount of Ni is preferably 0.80% or less, and the amount of B is preferably 0.005% or less.

The hot-rolled steel sheet according to the present embodiment may include at least one selected from the group consisting of 0% to 0.005% of Ca and 0% to 0.050% of REM. That is, in the hot-rolled steel sheet according to the present embodiment, the amount of Ca may be 0% to 0.005% and the amount of REM may be 0% to 0.050%.

(Ca: 0% to 0.005% and REM: 0% to 0.050%)

Ca and REM are elements effective for controlling a form of oxide and oxysulfide. Therefore, the steel sheet may include at least one selected from the group consisting of 0.0005% to 0.050% of REM and 0.0005% to 0.005% of Ca. When the amount of Ca or the amount of REM are excessive, the formability may be deteriorated. Therefore, an upper limit of the amount of REM is 0.050% and an upper limit of the amount of Ca is 0.005%. The amount of Ca may be 0%, and may also be less than 0.0005%. The amount of REM may be 0%, and may also be less than 0.0005%.

In the present invention, REM refers to an element of the lanthanoid series. REM is added in a Mischmetal state to steel in many cases. Therefore, the steel sheet includes two or more kinds selected from the elements of lanthanoid series such as La or Ce in many cases. Instead of Mischmetal, metal La or Ce may be added into the steel.

In the hot-rolled steel sheet according to the present embodiment, the remainder other than the above elements includes Fe and impurities, but the steel sheet may include trace amounts of other elements within a range that does not impair the effect of the present invention.

Hereinafter, a microstructure of the hot-rolled steel sheet according to the present embodiment will be described in detail.

Ferrite is the most important structure in order to secure the elongation. Since when the area ratio of ferrite is less than 90%, high elongation cannot be realized, the area ratio of ferrite is 90% or more. The area ratio of ferrite is preferably 91% or more, 92% or more, or 93% or more. However, since when the area ratio of ferrite exceeds 98%, the area ratio of martensite decreases, the strength of the steel sheet cannot be enhanced sufficiently by martensite. As a result, for example, when compensating for the insufficient strength by other methods such as precipitation strengthening, the uniform elongation deteriorates. Therefore, the area ratio of ferrite needs to be 98% or less. The area ratio of ferrite is preferably 97% or less, 96% or less, or 95% or less.

The martensite is an important structure in order to realize high strength and high hole expansibility. Since when an area ratio of the martensite is less than 2%, the strength is not sufficient, the area ratio of martensite is 2% or more. The area ratio of martensite is preferably 3% or more or 4% or more. On the other hand, when the area ratio of martensite exceeds 10%, even when the internal structure of martensite is controlled, high hole expansibility cannot be expressed. Therefore, the area ratio of the martensite needs to be 10% or less. The area ratio of martensite is preferably 9% or less or 8% or less.

In addition, as described above, martensite grains having a hardness of 10.0 GPa or more have low deformability and is extremely likely to form voids. Therefore, the lower the ratio of martensite grains having a hardness of 10.0 GPa or more to the total martensite grain, the better. Specifically, it is necessary to limit a number proportion (number density) of martensite grains of 10.0 GPa or more to total martensite grains to 10% or less. The number proportion of martensite grains of 10.0 GPa or more is preferably 5% or less, and may be 0%.

Further, the ratio (N1/N2) of the number N1 of martensite grains having a hardness of 8.0 GPa or more and less than 10.0 GPa to the number N2 of martensite grains having a hardness of less than 8.0 GPa needs to be 0.8 to 1.2. When (N1/N2) exceeds 1.2, voids are likely to be formed from martensite grains, and the hole expansibility deteriorates. On the other hand, when (N1/N2) is less than 0.8, the ratio of the soft martensite increases and the strength is insufficient. However, when the area ratio of martensite is increased in order to compensate for the insufficient strength, the hole expansibility and the elongation deteriorate. In order to increase the hole expansibility more stably, (N1/N2) is preferably 1.1 or less. In order to increase the strength more stably, (N1/N2) is preferably 0.9 or more.

Further, the hot-rolled steel sheet according to the present embodiment may include bainite and pearlite as the microstructure of the remainder, as long as the area ratio of bainite and pearlite are respectively 3% or less. The smaller the fractions (area ratio or area fraction) of bainite and pearlite, the better. In addition, as understood from a measuring method to be described later, since the sum of the area ratio of ferrite, the area ratio of martensite, the area ratio of pearlite, and the area ratio of bainite can be regarded as 100%, the sum of the area ratio of martensite, the area ratio of pearlite, and the area ratio of bainite is 2 to 10%.

Pearlite degrades the hole expansibility. Therefore, the smaller the fraction of pearlite, the better. The fraction of pearlite may be 0%. However, since when the area ratio of pearlite is 3% or less, the effect of pearlite on the hole expansibility is small, the area ratio of pearlite is allowed up to 3%. Therefore, the area ratio of pearlite is 0% to 3%. In order to enhance the hole expansibility more reliably, it is preferable to limit the area ratio of pearlite to 2% or less or 1% or less.

In addition, as the microstructure of the remainder, bainites other than pearlite may exist. Since bainite enhances the strength of the steel sheet and is also excellent in deformability, bainite does not degrade the hole expansibility of the steel sheet. However, the amount of increase in steel sheet strength due to bainite is smaller than the amount of increase in steel sheet strength due to martensite. Therefore, the hot-rolled steel sheet according to the present embodiment is not necessary to include the bainite, and the area ratio of the bainite may be 0%. When the area ratio of bainite is 3% or more, the strength is not sufficient. Therefore, the area ratio of bainite is 0% to 3%. In order to enhance the strength and the hole expansibility more reliably, it is preferable to limit the area ratio of bainite to 2% or less or 1% or less.

Here, the area ratios of ferrite, martensite, bainite, and pearlite are obtained by observing the microstructure with an optical microscope and identifying ferrite, martensite, bainite, and pearlite in the visual field (observation region). A sample for observation is taken from a position which is 1 m or more away from an edge of the steel sheet in a rolling direction and corresponds to the center of the width of the steel sheet so that a sheet thickness cross section parallel to the rolling direction of the steel sheet (cross section including the entire sheet thickness), is a surface (observed section). The surface (observed section) of the taken sample is polished and etched with nital reagent and repeller reagent to prepare two kinds of samples for observation. A region observed by the optical microscope is a region (¼ thickness region) away from the steel sheet surface by a quarter of the sheet thickness in the sheet thickness direction, in the observed section. Image processing is performed on an image of this observation region to measure the area fractions of the ferrite, the pearlite, and the martensite. It is defined that a region (remainder) other than the ferrite, the pearlite, and the martensite is the bainite. That is, the area ratio of bainite is calculated by subtracting the area ratio of the ferrite, the area ratio of martensite, and the area ratio of pearlite from 100. The magnification of the optical microscope is 500 times and the observation region is 5 visual fields. The area ratio of each structure (ferrite, martensite, pearlite, bainite) is obtained by averaging respective area ratios obtained in 5 visual fields.

In addition, the hardness of the martensite is measured by the nanoindentation method which can control indentation load by μN increments. The measurement sample is taken in the same manner as the sample for observation described above. In the measurement sample, cross section parallel to the rolling direction of the steel sheet (cross section including the entire sheet thickness) is polished with emery paper and then chemically polished with colloidal silica and is subjected to electrolytic polishing to remove the processed layer. In the nanoindentation method (indentation test), a Burkovich type indenter is used and the indentation load is 500 μN. The measurement region by the nanoindentation method is a region (¼ thickness region) away from the steel sheet surface by a quarter of the sheet thickness in the sheet thickness direction. The number of martensite grains to be measured is 30 or more. For example, the number of martensite grains to be measured is 30 to 60 grains. An upper limit of the number of martensite grains to be measured is not particularly limited. If the number of martensite grains to be measured is increased until the result does not fluctuate even if the number is increased, it is statistically sufficient.

The measured martensite grains are classified into three categories based on the hardness thereof. The internal structure of the martensite is evaluated in a predetermined number proportion of the three classes (the number proportion of martensite grains having a hardness of 10.0 GPa or more and the ratio of the number of martensite grains having a hardness of 8.0 GPa or more and less than 10.0 GPa to the number of martensite grains having a hardness of less than 8.0 GPa). For example, the hardness of 40 to 50 martensite grains in the region (¼ thickness region) away from the steel sheet surface by a quarter of the sheet thickness in the sheet thickness direction are measured. These martensite grains are classified into martensite grains having a hardness of less than 8.0 GPa, martensite grains having a hardness of 8.0 GPa or more and less than 10.0 GPa, and martensite grains having a hardness of 10.0 GPa or more. The number of martensite grains included in each class is counted. From the number of martensite grains in each class, the number proportion of martensite grains having a hardness of 10.0 GPa or more and the ratio of the number of martensite grains having a hardness of 8.0 GPa or more and less than 10.0 GPa to the number of martensite grains having a hardness of less than 8.0 GPa are calculated.

Hereinafter, a hot-rolled steel sheet according to a modification example of the present embodiment will be described in detail. The present modification example satisfies all the requirements of the above embodiment. In the present modification example, the Ti carbide in the microstructure is further controlled as follows.

Ti nitride and Ti sulfide are formed at a temperature higher than the Ti carbide. Therefore, not all Ti in steel can be effectively used as Ti carbide. Then, Tief (mass %) calculated by Equation (2) is defined as the amount of Ti that can be effectively used as the Ti carbide. In Equation (2), [Ti] represents the amount (mass %) of Ti, [N] represents the amount (mass %) of N, and [S] represents the amount (mass %) of S.

$$Tief=[Ti]-48/14\times[N]-48/32\times[S] \quad (2)$$

The Ti carbide is an important precipitate in order to further enhance the fatigue strength. Therefore, in order to impart excellent fatigue strength to the steel sheet, it is necessary to at least satisfy that the mass % (amount of Ti bonded with C) of Ti existing as Ti carbide is 40% (0.4 times or more) of Tief calculated by the above Equation (2). Therefore, in order to enhance the fatigue strength, the mass % of Ti existing as Ti carbide is preferably 40% or more of Tief, and more preferably 45% or more (0.45 times or more). Since when the mass % of Ti existing as Ti carbide is less than 40% of Tief calculated by the above Equation (2), the effect of the Ti carbide having a circle equivalent grain size of 7 nm to 20 nm on the fatigue strength cannot be sufficiently exhibited, excellent fatigue strength cannot be imparted to the steel sheet.

In addition, as described above, the Ti carbide having a circle equivalent grain size of 7 nm to 20 nm enhance the fatigue strength of the hot-rolled steel sheet. On the other hand, Ti carbide having a circle equivalent grain size of smaller than 7 nm and Ti carbide having a circle equivalent grain size of greater than 20 nm hardly enhance the fatigue strength. FIG. 1 is a diagram showing an example of the relationship between the ratio of Ti carbide of 7 to 20 nm to the entire Ti carbide and (c-YP)/YP. The data in FIG. 1 satisfies conditions of the present modification example except for the ratio of Ti carbide of 7 to 20 nm to the entire Ti carbide. As shown in FIG. 1, when the ratio of the total mass of the Ti carbide having a circle equivalent grain size of 7 nm to 20 nm to the total mass of all Ti carbide is 50% or more, the Ti carbide enhances the fatigue strength. Therefore, the ratio of the cyclic yield stress (c-YP) to the yield stress (YP) can be increased up to 0.90 or more. Therefore, in order to impart excellent fatigue strength to the steel sheet, the ratio of the total mass of Ti carbide having a circle equivalent grain size of 7 nm to 20 nm to a total mass of all Ti carbide needs to be 50% or more. Therefore, the ratio of the total mass of Ti carbide having a circle equivalent grain size of 7 nm to 20 nm to the total mass of all Ti carbide is preferably 50% or more. Since the ratio of the total mass of the Ti carbide having a circle equivalent grain size of 7 nm to 20 nm to the total mass of all Ti carbide is less than 50%, the effect of the Ti carbide having a circle equivalent grain size of 7 nm to 20 nm on the fatigue strength is not sufficient, excellent fatigue strength cannot be imparted to the steel sheet.

Accordingly, when the mass % of Ti existing as Ti carbide is 40% or more and the ratio of the total mass of the Ti carbide having a circle equivalent grain size of 7 nm to 20 nm to the total mass of all Ti carbide is 50% or more, the ratio of the cyclic yield stress (c-YP) to the yield stress (YP) can be increased up to 0.90 or more.

The mass % of Ti existing as Ti carbide is determined by a method as follows. A predetermined amount of a steel sheet is dissolved by electrolysis and a weight of Ti in residue is quantified to determine the total weight of Ti in precipitate. In addition, the total weight of nitrogen included in the dissolved steel sheet is calculated from the weight of the dissolved steel sheet and the mass % of nitrogen in the steel sheet, and the total weight of Ti in TiN is determined by multiplying the total weight of nitrogen by 48/14. The total weight of Ti in Ti carbide is obtained by subtracting the total weight of Ti in Ti nitride (TiN) from the total weight of Ti in the precipitate, and the mass % of Ti existing as Ti carbide is calculated from the total weight of Ti in the Ti carbide and the weight of the dissolved steel sheet.

The ratio of the total mass of Ti carbide having a circle equivalent grain size of 7 nm to 20 nm to the total mass of all Ti carbide is determined by a method as follows. At least 20 regions of 10 μm×10 μm are selected from an element distribution image obtained by using 3D-AP (three dimensional atom probe). In each region, particles including Ti and C are identified as Ti carbide and a circle equivalent grain sizes of Ti carbide having a circle equivalent grain size of 1 nm to 100 nm are measured. When measuring the circle equivalent grain size of Ti carbide, a magnification of the element distribution image is appropriately selected according to the circle equivalent grain size of Ti carbide and a significant figure in order to improve accuracy. From the obtained particle size distribution and the density of the Ti carbide, the ratio of the weight of Ti carbide having a circle equivalent grain size of 7 nm to 20 nm to a weight of Ti carbide having a circle equivalent grain size of 1 nm to 100 nm is calculated, and this ratio is regarded as the ratio of the total mass of Ti carbide having a circle equivalent grain size of 7 nm to 20 nm to the total mass of all Ti carbide.

Figure 2:
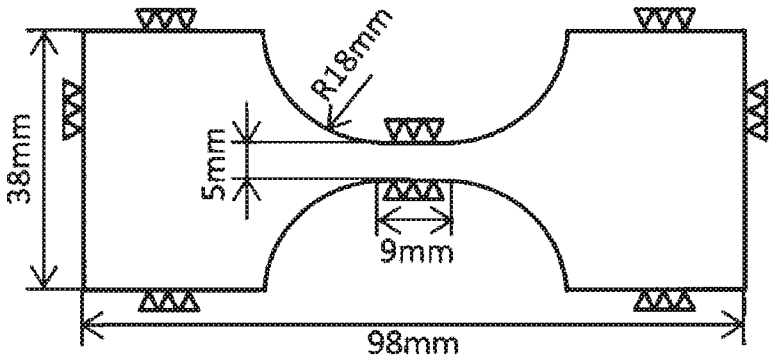
FIG. 2 is a diagram showing a dimension and a shape of a test piece in a low cycle fatigue test.
Figure 3:
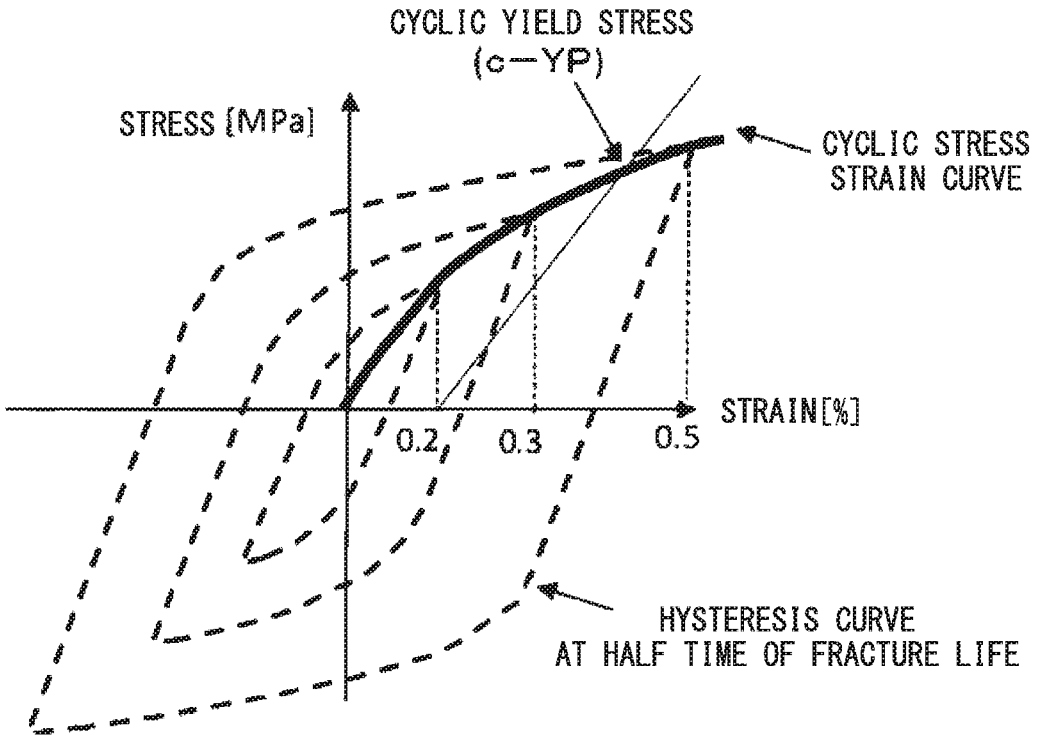
FIG. 3 is a diagram showing a method of determining a cyclic yield stress from a cyclic stress strain curve.

The cyclic yield stress (c-YP) is determined by a method as follows. In order to obtain a relationship between the number of cycles and the maximum stress corresponding to this number of cycles, a cyclic load is applied to the test piece at a strain rate of 0.4%/s and a strain amplitude of 0.2% until the test piece shown in FIG. 2 is broken in a low cycle fatigue test. The low cycle fatigue test is also carried out at strain amplitudes of 0.3%, 0.5%, 0.8%, and 1.0%. Thereafter, from the test result at each strain amplitude, the maximum stress corresponding to a half number of cycles of the number of cycles at the time of breaking is determined, and the relation between the strain amplitude and the maximum stress (cyclic stress strain curve) is obtained. As shown in FIG. 3, a straight line having a slope of Young's modulus is inserted at the point of strain 0.2% and stress 0 MPa and an intersection point of the straight line and the cyclic stress strain curve is obtained. The stress at the intersection point is determined to be the cyclic yield stress (c-YP).

The surface of the hot-rolled steel sheet according to the embodiment and the modification example thereof which are described above may have one or more surface layers (surface film) obtained by performing a surface treatment using organic film formation, film lamination, an organic salt or inorganic salt treatment, a non-chromate treatment, a plating treatment, and the like. Even when the hot-rolled steel sheet has these surface layers, the effect of the present invention can be sufficiently obtained without being inhibited.

In the tensile strength of the hot-rolled steel sheets according to the embodiment and the modification example thereof, since it is desirable to increase the tensile strength according to the amount of Ti in the hot-rolled steel sheet, the tensile strength is preferably 500 MPa or more and (2500×([Ti]−0.02)+500) MPa or more. Similarly, a product of the tensile strength and the elongation is preferably (13000×[Ti]+15000) MPa·% or more, and a product of the tensile strength and the hole expansibility is preferably 70000 MPa % or more. Here, [Ti] represents the amount (mass %) of Ti.

Hereinafter, a manufacturing method of the hot-rolled steel sheet according to the embodiment and the modification example thereof will be described in detail.

The manufacturing method preceding hot rolling is not particularly limited except for melting the steel such that a chemical composition of molten steel falls within the range of the chemical composition of the hot-rolled steel sheet according to the embodiment. That is, it is possible to manufacturing a steel piece by melting a steel firstly by a usual method, adjusting the chemical composition of the molten steel within the range of the chemical composition described above, and casting. From the viewpoint of productivity, it is preferable to perform casting by continuous casting.

Next, the steel piece (slab) having the chemical composition of the present embodiment is heated before the hot rolling. When the slab heating temperature is 1150° C. or higher. Ti carbide can be sufficiently solutionized. Therefore, fine Ti carbide are obtained during cooling after finish rolling, the strength and the fatigue strength can be further enhanced. Therefore, the slab heating temperature is preferably 1150° C. or higher. The upper limit of the slab heating temperature is not particularly determined. However, in order to reduce the manufacturing costs, the slab heating temperature is preferably 1300° C. or lower. In addition, it is not necessary to heat the slab before the hot rolling. For example, while maintaining the temperature of the cast slab at 1150° C. or higher, the slab may be sent directly to the hot rolling machine to be subjected to hot rolling.

After heating the slab, rough rolling and finish rolling are performed in the hot rolling process.

When the rough rolling finishing temperature is 1000° C. or higher, it is possible to suppress precipitation of Ti carbide which does not enhance the strength due to strain induction in an austenite region. Therefore, it is possible to secure a sufficient amount of solid solution Ti necessary for causing the Ti carbide, which enhances the strength, to be precipitated in a subsequent process. Therefore, the rough rolling finishing temperature is preferably 1000° C. to 1300° C. More preferably, the rough rolling finishing temperature is 1050° C. or higher or 1080° C. or higher.

The finish rolling finishing temperature is 850° C. to 1000° C. When the finish rolling finishing temperature exceeds 1000° C., ferrite nucleation site decreases due to an increase of grain size of recrystallized austenite (γ), and the ferritic transformation is significantly delayed. As a result, the area ratio of the ferrite decreases and sufficient elongation cannot be secured. Therefore, the finish rolling finishing temperature is 1000° C. or lower. In addition, in order to improve the elongation stably, finish rolling finishing temperature is preferably 950° C. or lower. On the other hand, when the finish rolling finishing temperature is lower than 850° C., ferritic transformation starts before the next primary cooling, and driving force of the ferritic transformation during primary cooling decreases. Therefore, even when the cooling rate of the primary cooling is increased, the effect of the primary cooling on concentration of carbon into the austenite grains is not sufficient. As a result, martensite grains having a hardness of 8.0 GPa or more decreases and (N1/N2) becomes less than 0.8. The strength is insufficient. Therefore, the finish rolling finishing temperature is 850° C. or higher.

In this manner, in the hot rolling process, the finish rolling is performed after the rough rolling, and the finish rolling is finished at a temperature range of 850° C. to 1000° C.

After the finish rolling, primary cooling, secondary cooling, tertiary cooling, quaternary cooling, and coiling are performed in this order.

After the finish rolling, the primary cooling is performed from finish rolling finishing temperature to secondary cooling starting temperature. In the primary cooling, the average cooling rate (primary cooling rate) from the finish rolling finishing temperature to the secondary cooling starting temperature is 20° C./s or faster.

Here, in order to form martensite grains having various hardness in the same microstructure, it is effective to control the amount of carbon included in each martensite grain.

The amount of carbon in austenite before the martensitic transformation increases as carbon moves from the ferrite to the austenite when austenite is transformed to the ferrite. As the ferritic transformation proceeds, the austenite is separated by the ferrite to be isolated. Therefore, carbon cannot move between austenite grains. The amount of carbon in the austenite grains varies depending on a temperature of the ferritic transformation occurring around austenite grains. Accordingly, austenite grains having various amounts of carbon in the same microstructure can be obtained, by fluctuating the temperature of the ferritic transformation and locally fluctuating the ferritic transformation ratio in the same microstructure. Since martensite is obtained by transformation of the austenite, it is possible to obtain martensite grains having a wide range of hardness as a result.

Martensite grains having various hardness can be obtained by controlling the primary cooling rate to 20° C./s or faster. During the primary cooling, the ferritic transformation occurs in a wide range of temperature, and the amount of carbon in austenite grains, that is, the amount of carbon to be concentrated into the austenite grains changes according to the temperature range. As a result, austenite grains including various amounts of carbon are obtained, and martensite grains of various hardness can be obtained from these austenite grains.

In a case where the primary cooling rate is slower than 20° C./s, the ferritic transformation proceeds only in a high temperature range. As a result, since the driving force of the ferritic transformation is small, the ferritic transformation rate is slow, and most of austenite grains are occupied by austenite grains having a small amount of carbon. Therefore, martensite grains having a hardness of 8.0 GPa or more decreases and (N1/N2) becomes less than 0.8. The strength is insufficient.

When the amount of martensite grains of 8.0 to 10.0 GPa is increased in order to enhance the strength of the steel sheet, the primary cooling rate is preferably 30° C./s or faster or 40° C./s or faster.

After the primary cooling, the secondary cooling is performed in some sections of 600° C. to 750° C. That is, the secondary cooling starting temperature (primary cooling stopping temperature) is a temperature of higher than 600° C. and 750° C. or lower. When the secondary cooling starting temperature exceeds 750° C. the driving force of the ferritic transformation decreases and the area ratio of the ferrite becomes less than 90%. Therefore, the elongation deteriorates. In addition, in order to set the mass % of Ti existing as Ti carbide to 40% or more of Tief, it is necessary that the secondary cooling starting temperature is 750° C. or lower. On the other hand, when the secondary cooling starting temperature is 600° C. or lower, the area ratio of the bainite exceeds 3% or the area ratio of the ferrite becomes less than 90%. Therefore, the elongation deteriorates. In addition, the lower the secondary cooling starting temperature, the smaller the carbide equivalent grain size of Ti carbide. The amount of fine Ti carbide increases. Therefore, in order to increase the ratio of the total mass of Ti carbide having a circle equivalent grain size of 7 nm to 20 nm to the total mass of all Ti carbide up to 50% or more by limiting the amount of Ti carbide having a circle equivalent average size of less than 7 nm, the secondary cooling starting temperature needs to be 670° C. or higher. Therefore, in order to obtain excellent fatigue strength, the secondary cooling starting temperature is preferably 670° C. to 750° C. The secondary cooling finishing temperature (tertiary cooling starting temperature) is 600° C. or higher and lower than the secondary cooling starting temperature.

The average cooling rate in the secondary cooling is 10° C./s or slower and a secondary cooling time is 2 to 10 seconds. When the average cooling rate exceeds 10° C./s or the secondary cooling time is shorter than 2 seconds, the area ratio of the ferrite decreases and elongation deteriorates. In addition, in order to set the mass % of Ti existing as Ti carbide to 40% or more of Tief, it is necessary that the secondary cooling time is 2 seconds or longer. On the other hand, when the secondary cooling time is longer than 10 seconds, the area ratio of the pearlite increases and the hole expansibility deteriorates. In order to obtain the elongation more stably, the secondary cooling time is preferably 3 seconds or longer or 5 seconds or longer. In order to obtain the hole expansibility more stably, the secondary cooling time is preferably 9 seconds or shorter or 7 seconds or shorter. The secondary cooling finishing temperature is a temperature at the time when the secondary cooling time has elapsed from the start of the secondary cooling and is calculated from the secondary cooling starting temperature, the average cooling rate of the secondary cooling, and the secondary cooling time.

As described above, it is not possible to obtain a desired microstructure simply by controlling hot rolling, primary cooling, and secondary cooling. That is, a desired microstructure can be obtained by further controlling cooling after the secondary cooling (tertiary cooling and quaternary cooling).

After the secondary cooling, the tertiary cooling is performed. In the tertiary cooling, the steel sheet is cooled at an average cooling rate of more than 80° C./s in a temperature range from the secondary cooling finishing temperature to 400° C. to form martensite from the austenite having a small amount of carbon. In the temperature range, the carbon diffusion rate is fast. Therefore, when the average cooling rate is 80° C./s or slower, the carbide is formed and grown in a short time and the martensite is significantly softened. As a result, N1/N2 decreases to less than 0.8 and the strength is not sufficient. The upper limit of the tertiary cooling rate is not particularly limited. In order to increase the accuracy of the cooling stop temperature, it is preferable to set the tertiary cooling rate to 200° C./s or slower.

After the tertiary cooling, the quaternary cooling is performed. In the quaternary cooling, the steel sheet is cooled at an average cooling rate of 30 to 80° C./s in a temperature range from 400° C. to 100° C. In the range of 100° C. to 400° C., martensite is formed from the austenite having a large amount of carbon. In the low temperature range, when the average cooling rate is faster than 80° C./s, the carbide cannot be formed sufficiently. Therefore, the number proportion of martensite grains having a hardness of 10.0 GPa or more becomes 10% or more, and voids are likely to be formed. Therefore, the hole expansibility deteriorates. On the other hand, when the quaternary cooling rate is slower than 30° C./s, excess carbide precipitates and martensite grains soften. Therefore, N1/N2 decreases to less than 0.8 and the strength is not sufficient. In order to improve the hole expansibility more stably by limiting the amount of martensite grains having a hardness of 10.0 GPa or more, the quaternary cooling rate is preferably 70° C./s or slower. In addition, in order to enhance the strength by increasing the amount of martensites having a hardness of 8.0 GPa or more and less than 10.0 GPa, the quaternary cooling rate is preferably 50° C./s or faster. After the quaternary cooling, the hot-rolled steel sheet is coiled. Therefore, the coiling temperature is 100° C. or lower.

The hot-rolled steel sheet according to the above embodiment can be manufactured by the manufacturing method of the hot-rolled steel sheet according to the above embodiment.

In addition, a surface treatment using organic film formation, film lamination, an organic salt or inorganic salt treatment, a non-chromate treatment, and the like may be performed.

EXAMPLES

Hereinafter, technical contents of the present invention will be further described while giving Examples of the present invention. A condition in Examples to be shown in the following is a condition example adopted to confirm an implementation possibility and effects of the present invention. The present invention is not limited to the condition example. In addition, the present invention may adopt various conditions as long as it does not depart from the gist of the present invention and achieves the object of the present invention.

A steel having the chemical composition shown in Table 1 was melted and cast to obtain a steel piece. In hot rolling, the obtained steel piece was heated to 1150° C., and then, rough rolling and finish rolling were performed. A rough rolling finishing temperature was 1000° C. The finish rolling finishing temperature (FT) was the temperature shown in Tables 2 to 4. Thereafter, primary cooling (cooling from a finish rolling finishing temperature to a secondary cooling starting temperature), secondary cooling (cooling from the start of the secondary cooling to the time when the secondary cooling time has elapsed), tertiary cooling (cooling from a secondary cooling finishing temperature to 400° C.), and quaternary cooling (cooling from 400° C. to 100° C.) were performed under the conditions shown in Tables 2 to 4, and the steel sheet was coiled. The sheet thickness of the hot-rolled steel sheet was 3.2 mm. In Tables 2 to 4, the "Primary cooling rate" indicates an average cooling rate in the temperature range from the finish rolling finishing temperature (FT) to the secondary cooling starting temperature. The "Secondary cooling rate" indicates the average cooling rate from the start of the secondary cooling to the time when the secondary cooling time has elapsed. The "Tertiary cooling rate" indicates the average cooling rate in the temperature range from the secondary cooling finishing temperature to 400° C. The "quaternary cooling rate" indicates the average cooling rate in the temperature range from 400° C. to 100° C. In Table 1, underlines are given to the columns that do not satisfy the essential conditions shown in embodiments described above. In Tables 2 to 4, underlines are given to the columns that do not satisfy the essential conditions shown in the manufacturing method described above.

TABLE 1

| Steel | Chemical composition Mass % (remainder: Fe and impurities) | | | | | | | | | | |
|---|---|---|---|---|---|---|---|---|---|---|---|
| No. | C | Si | Mn | P | S | Al | N | Ti | Others | Si + Al | Note |
| A | 0.040 | 0.05 | 1.0 | 0.011 | 0.0066 | 0.03 | 0.0043 | 0.041 | Nb = 0.02 | 0.08 | Invention Example |
| B | 0.051 | 0.05 | 1.0 | 0.014 | 0.0073 | 0.03 | 0.0053 | 0.040 | V = 0.05 | 0.08 | Invention Example |
| C | 0.045 | 0.10 | 1.0 | 0.007 | 0.0064 | 0.25 | 0.0058 | 0.033 | W = 0.1 | 0.35 | Invention Example |
| D | 0.045 | 0.30 | 1.4 | 0.007 | 0.0025 | 0.09 | 0.0031 | 0.050 | Ca = 0.004 | 0.39 | Invention Example |
| E | 0.055 | 0.05 | 0.9 | 0.011 | 0.0053 | 0.10 | 0.0035 | 0.065 | B = 0.002 | 0.15 | Invention Example |
| F | 0.045 | 0.05 | 1.6 | 0.014 | 0.0022 | 0.10 | 0.0053 | 0.062 | Cu = 0.1, Ni = 0.04 | 0.15 | Invention Example |
| G | 0.045 | 0.05 | 0.6 | 0.011 | 0.0021 | 0.10 | 0.0041 | 0.059 | Cr = 0.1, REM = 0.002 | 0.15 | Invention Example |
| H | 0.044 | 0.08 | 1.0 | 0.011 | 0.0066 | 0.03 | 0.0043 | 0.100 | Nb = 0.02 | 0.11 | Invention Example |
| I | 0.065 | 0.08 | 1.0 | 0.014 | 0.0073 | 0.03 | 0.0053 | 0.080 | V = 0.05, Mo = 0.1 | 0.11 | Invention Example |
| J | 0.043 | 0.10 | 1.0 | 0.007 | 0.0064 | 0.15 | 0.0058 | 0.100 | W = 0.1, Cr = 0.1 | 0.25 | Invention Example |
| K | 0.043 | 0.10 | 1.4 | 0.007 | 0.0025 | 0.09 | 0.0031 | 0.120 | Ca = 0.004 | 0.19 | Invention Example |
| L | 0.032 | 0.05 | 0.9 | 0.011 | 0.0053 | 0.10 | 0.0035 | 0.120 | Cu = 0.2, Ni = 0.03, B = 0.002 | 0.15 | Invention Example |
| M | 0.041 | 0.05 | 1.6 | 0.014 | 0.0022 | 0.10 | 0.0053 | 0.120 | REM = 0.003 | 0.15 | Invention Example |
| N | 0.041 | 0.05 | 0.6 | 0.011 | 0.0021 | 0.10 | 0.0041 | 0.140 | | 0.15 | Invention Example |
| O | 0.053 | 0.06 | 1.9 | 0.016 | 0.0038 | 0.31 | 0.0060 | 0.046 | | 0.37 | Invention Example |
| a | 0.045 | 0.02 | 1.1 | 0.008 | 0.0055 | 0.05 | 0.0056 | 0.060 | | 0.07 | Comparative Example |
| b | 0.075 | 0.05 | 0.8 | 0.013 | 0.0053 | 0.10 | 0.0030 | 0.061 | B = 0.004 | 0.15 | Comparative Example |
| c | 0.024 | 0.05 | 1.2 | 0.007 | 0.0056 | 0.10 | 0.0045 | 0.035 | Cu = 0.1 | 0.15 | Comparative Example |
| d | 0.045 | 0.30 | 0.9 | 0.012 | 0.0079 | 0.15 | 0.0046 | 0.050 | REM = 0.002 | 0.45 | Comparative Example |
| e | 0.045 | 0.05 | 1.1 | 0.013 | 0.0051 | 0.10 | 0.0059 | 0.014 | | 0.15 | Comparative Example |
| f | 0.045 | 0.05 | 2.1 | 0.013 | 0.0053 | 0.10 | 0.0056 | 0.045 | Ni = 0.02 | 0.15 | Comparative Example |
| g | 0.045 | 0.05 | 0.4 | 0.005 | 0.0049 | 0.10 | 0.0048 | 0.045 | Cr = 0.1 | 0.15 | Comparative Example |
| h | 0.045 | 0.02 | 1.1 | 0.008 | 0.0055 | 0.05 | 0.0056 | 0.110 | | 0.07 | Comparative Example |
| i | 0.075 | 0.05 | 0.8 | 0.013 | 0.0053 | 0.10 | 0.0030 | 0.110 | B = 0.004 | 0.15 | Comparative Example |
| j | 0.024 | 0.05 | 1.2 | 0.007 | 0.0056 | 0.10 | 0.0045 | 0.110 | Cu = 0.1 | 0.15 | Comparative Example |
| k | 0.045 | 0.30 | 0.9 | 0.012 | 0.0079 | 0.15 | 0.0046 | 0.130 | REM = 0.002 | 0.45 | Comparative Example |
| l | 0.048 | 0.05 | 1.1 | 0.014 | 0.0029 | 0.10 | 0.0045 | 0.160 | | 0.15 | Comparative Example |
| m | 0.048 | 0.05 | 2.1 | 0.013 | 0.0053 | 0.10 | 0.0056 | 0.100 | Ni = 0.02 | 0.15 | Comparative Example |
| n | 0.048 | 0.05 | 0.4 | 0.005 | 0.0049 | 0.10 | 0.0048 | 0.100 | Cr = 0.1 | 0.15 | Comparative Example |

TABLE 2

| No. | Steel No. | FT ° C. | Primary cooling rate ° C./s | Secondary cooling starting temperature ° C. | Secondary cooling rate ° C./s | Secondary cooling time sec | Tertiary cooling rate ° C./s | Quaternary cooling rate ° C./s | Note |
|---|---|---|---|---|---|---|---|---|---|
| A-1 | A | 975 | 30 | 661 | 8 | 2.8 | 86 | 34 | Invention Example |
| A-2 | | 970 | 20 | 720 | 9 | 4.6 | 120 | 58 | Invention Example |
| A-3 | | 978 | 20 | 782 | 6 | 4.1 | 113 | 74 | Comparative Example |
| A-4 | | 927 | 50 | 620 | 3 | 5.2 | 84 | 48 | Invention Example |
| A-5 | | 916 | 40 | 660 | 9 | 5.8 | 122 | 76 | Invention Example |
| A-6 | | 893 | 50 | 663 | 5 | 5.1 | 113 | 32 | Invention Example |
| A-7 | | 969 | 30 | 670 | 6 | 4.1 | 113 | 51 | Invention Example |
| A-8 | | 970 | 30 | 680 | 16 | 5.2 | 106 | 68 | Comparative Example |
| A-9 | | 830 | 40 | 680 | 9 | 6.0 | 111 | 75 | Comparative Example |
| A-10 | | 975 | 30 | 670 | 5 | 7.0 | 50 | 50 | Comparative Example |
| A-11 | | 975 | 30 | 670 | 5 | 7.0 | 80 | 80 | Comparative Example |
| A-12 | | 975 | 30 | 670 | 3 | 7.0 | 70 | 70 | Comparative Example |

TABLE 2-continued

| No. | Steel No. | FT ° C. | Primary cooling rate ° C./s | Secondary cooling starting temperature ° C. | Secondary cooling rate ° C./s | Secondary cooling time sec | Tertiary cooling rate ° C./s | Quaternary cooling rate ° C./s | Note |
|---|---|---|---|---|---|---|---|---|---|
| A-13 | | 975 | 30 | 670 | 3 | 7.0 | 80 | 50 | Comparative Example |
| A-14 | | 975 | 30 | 670 | 8 | 7.0 | 50 | 80 | Comparative Example |
| B-1 | B | 939 | 50 | 669 | 10 | 4.1 | 108 | 39 | Invention Example |
| B-2 | | 1015 | 30 | 668 | 9 | 4.2 | 114 | 42 | Comparative Example |
| B-3 | | 964 | 40 | 681 | 8 | 5.6 | 93 | 38 | Invention Example |
| B-4 | | 930 | 40 | 666 | 8 | 4.7 | 65 | 54 | Comparative Example |
| B-5 | | 939 | 30 | 658 | 6 | 7.4 | 88 | 56 | Invention Example |
| B-6 | | 935 | 20 | 677 | 4 | 3.5 | 111 | 32 | Invention Example |
| C-1 | C | 946 | 30 | 683 | 7 | 1.5 | 96 | 51 | Comparative Example |
| C-2 | | 968 | 20 | 690 | 10 | 7.5 | 93 | 73 | Invention Example |
| C-3 | | 915 | 30 | 680 | 9 | 3.6 | 96 | 36 | Invention Example |
| D-1 | D | 951 | 30 | 681 | 3 | 11.0 | 110 | 49 | Comparative Example |
| D-2 | | 912 | 15 | 659 | 5 | 6.8 | 98 | 35 | Comparative Example |
| D-3 | | 910 | 50 | 676 | 3 | 5.3 | 110 | 40 | Invention Example |
| E-1 | E | 881 | 20 | 659 | 10 | 4.2 | 98 | 45 | Invention Example |
| E-2 | | 969 | 20 | 667 | 5 | 2.5 | 98 | 13 | Comparative Example |
| F-1 | F | 967 | 20 | 682 | 3 | 3.0 | 114 | 43 | Invention Example |
| G-1 | G | 893 | 50 | 672 | 9 | 6.8 | 103 | 68 | Invention Example |
| G-2 | | 913 | 40 | 662 | 9 | 6.8 | 96 | 113 | Comparative Example |

TABLE 3

| No. | Steel No. | FT ° C. | Primary cooling rate ° C./s | Secondary cooling starting temperature ° C. | Secondary cooling rate ° C./s | Secondary cooling time sec | Tertiary cooling rate ° C./s | Quaternary cooling rate ° C./s | Note |
|---|---|---|---|---|---|---|---|---|---|
| H-1 | H | 955 | 43 | 667 | 8 | 3.8 | 110 | 72 | Invention Example |
| H-2 | | 861 | 43 | 681 | 3 | 4.6 | 83 | 62 | Invention Example |
| H-3 | | 868 | 58 | 658 | 3 | 5.2 | 83 | 45 | Invention Example |
| H-4 | | 965 | 37 | 666 | 4 | 3.6 | 84 | 51 | Invention Example |
| H-5 | | 923 | 42 | 668 | 7 | 5.8 | 108 | 56 | Invention Example |
| H-6 | | 883 | 42 | 680 | 6 | 4.1 | 118 | 58 | Invention Example |
| H-7 | | 973 | 45 | 685 | 25 | 5.4 | 118 | 72 | Comparative Example |
| H-8 | | 841 | 49 | 684 | 3 | 4.8 | 122 | 74 | Comparative Example |
| I-1 | I | 941 | 44 | 659 | 10 | 4.1 | 93 | 39 | Invention Example |
| I-2 | | 955 | 24 | 665 | 9 | 5.6 | 96 | 40 | Invention Example |
| I-3 | | 1030 | 34 | 675 | 5 | 4.2 | 109 | 41 | Comparative Example |
| I-4 | | 942 | 38 | 684 | 7 | 7.4 | 98 | 36 | Invention Example |
| I-5 | | 898 | 32 | 668 | 9 | 4.7 | 52 | 53 | Comparative Example |
| I-6 | | 957 | 42 | 682 | 6 | 3.5 | 123 | 48 | Invention Example |
| I-7 | | 950 | 40 | 782 | 5 | 3.8 | 112 | 59 | Comparative Example |
| J-1 | J | 935 | 41 | 677 | 9 | 1.5 | 105 | 69 | Comparative Example |
| J-2 | | 946 | 55 | 670 | 6 | 7.5 | 120 | 74 | Invention Example |

TABLE 3-continued

| No. | Steel No. | FT ° C. | Primary cooling rate ° C./s | Secondary cooling starting temperature ° C. | Secondary cooling rate ° C./s | Secondary cooling time sec | Tertiary cooling rate ° C./s | Quaternary cooling rate ° C./s | Note |
|---|---|---|---|---|---|---|---|---|---|
| J-3 | | 968 | 43 | 684 | 8 | 3.6 | 121 | 57 | Invention Example |
| K-1 | K | 915 | 32 | 662 | 3 | 10.8 | 93 | 32 | Comparative Example |
| K-2 | | 889 | 57 | 674 | 8 | 5.3 | 92 | 75 | Invention Example |
| K-3 | | 922 | 15 | 680 | 10 | 6.8 | 95 | 52 | Comparative Example |
| L-1 | L | 926 | 24 | 666 | 5 | 4.2 | 93 | 63 | Invention Example |
| L-2 | | 886 | 53 | 674 | 3 | 3.5 | 105 | 24 | Comparative Example |
| M-1 | M | 878 | 46 | 673 | 7 | 3.0 | 110 | 63 | Invention Example |
| N-1 | N | 923 | 38 | 680 | 9 | 6.8 | 123 | 63 | Invention Example |
| N-2 | | 901 | 38 | 680 | 6 | 6.8 | 89 | 95 | Comparative Example |
| O-1 | O | 943 | 34 | 660 | 9 | 6.1 | 102 | 63 | Invention Example |

TABLE 4

| No. | Steel No. | FT ° C. | Primary cooling rate ° C./s | Secondary cooling starting temperature ° C. | Secondary cooling rate ° C./s | Secondary cooling time sec | Tertiary cooling rate ° C./s | Quaternary cooling rate ° C./s | Note |
|---|---|---|---|---|---|---|---|---|---|
| a-1 | a | 972 | 40 | 675 | 8 | 4.7 | 101 | 66 | Comparative Example |
| b-1 | b | 905 | 50 | 680 | 9 | 2.9 | 103 | 75 | Comparative Example |
| c-1 | c | 909 | 20 | 675 | 3 | 3.9 | 112 | 72 | Comparative Example |
| d-1 | d | 882 | 40 | 671 | 9 | 2.2 | 107 | 63 | Comparative Example |
| e-1 | e | 978 | 20 | 683 | 3 | 5.9 | 106 | 72 | Comparative Example |
| f-1 | f | 936 | 50 | 663 | 5 | 6.8 | 84 | 74 | Comparative Example |
| g-1 | g | 940 | 50 | 678 | 7 | 6.8 | 113 | 33 | Comparative Example |
| h-1 | h | 939 | 58 | 660 | 8 | 4.7 | 108 | 34 | Comparative Example |
| i-1 | i | 932 | 51 | 675 | 3 | 3.1 | 102 | 32 | Comparative Example |
| j-1 | j | 942 | 51 | 663 | 5 | 3.9 | 119 | 37 | Comparative Example |
| k-1 | k | 965 | 24 | 672 | 10 | 2.2 | 92 | 46 | Comparative Example |
| l-1 | l | 865 | 47 | 679 | 9 | 3.4 | 117 | 40 | Comparative Example |
| m-1 | m | 885 | 37 | 677 | 4 | 6.8 | 97 | 40 | Comparative Example |
| n-1 | n | 875 | 48 | 670 | 7 | 6.8 | 107 | 60 | Comparative Example |

A microstructure was identified using an optical microscope as follows. Samples were taken from the obtained hot-rolled steel sheets (No. A-1 to No. O-1 and No. a-1 to n-1). Sheet thickness cross sections parallel to the rolling direction were polished and the polished surface was etched with a reagent. As the reagent, an nital reagent and a repeller reagent were used. A sample obtained by etching the polished surface with the nital reagent and a sample obtained by etching the polished surface with the repeller reagent were prepared. A quarter-thickness region in the sample obtained by etching with the nital reagent was observed with an optical microscope at magnification of 500 times, and photographs of five regions (visual fields) were taken. The area ratio of the ferrite and an area ratio of the pearlite were obtained by image analysis of the photographs. In addition, a quarter-thickness region in the sample obtained by etching the polished surface with the repeller reagent was observed with an optical microscope at magnification of 500 times, and photographs of five regions (visual fields) were taken. The area ratio of the martensite was obtained by image analysis of the photographs. The area ratio of the bainite was calculated by subtracting the area ratio of the ferrite, the area ratio of the pearlite, and the area ratio of the martensite, from 100.

In addition, for the obtained hot-rolled steel sheets (No. A-1 to No. O-1 and No. a-1 to No. n-1), the following characteristics were evaluated.

Yield stress (YP), tensile strength (TS), elongation (El) were evaluated by conducting a tensile test in accordance with JIS Z 2241 for No. 5 test piece disclosed in JIS Z 2201. The test piece was taken from a position away from the edge of the steel sheet in a sheet width direction by a quarter of a sheet width such that the longitudinal direction of the test piece matches a direction perpendicular to the rolling direction (sheet width direction). In addition, when the tensile strength (TS) was 500 MPa or more and (2500×([Ti]−0.02)+500) MPa or more, the strength of the steel sheet was evaluated as sufficient. In Tables 8 to 10, underlines are given to the columns that were evaluated as not sufficient for the strength of the steel sheet. When a product (TS×El) of the tensile strength (TS) and the elongation (El) was (13000×[Ti]+15000) MPa % or more, the elongation of the steel sheet was evaluated as sufficient. In Tables 8 to 10, underlines are given to the columns that are evaluated as not sufficient for the elongation of the steel sheet.

A hole expansion test was performed in accordance with the hole expansion test method described in Japan Iron and Steel Federation Standard JFS T 1001-1996 and the hole expansion value (λ) was evaluated. When a product (TS×λ) of the tensile strength (TS) and the hole expansion value (λ) was 70000 MPa % or more, the hole expansibility of the steel sheet was evaluated as sufficient. In Tables 8 to 10, underlines are given to the columns that are evaluated as not sufficient for the hole expansibility of the steel sheet.

In the present example, the hardness of martensite grains was obtained by the nanoindentation method. Specifically, a sheet thickness cross section parallel to the rolling direction of testing steel was polished with emery paper and then chemically polished with colloidal silica and is subjected to electrolytic polishing to remove the processed layer. In the nanoindentation method, a Burkovich type indenter was used and the indentation load to the polished surface was 500 μN. The impression size was 0.1 μm or less of diameter.

In the present examples, 40 to 50 martensite grains in the ¼ thickness region were measured and these martensite grains were classified into three classes of a hardness range of less than 8.0 GPa, a hardness range of 8.0 GPa or more and less than 10.0 GPa (8.0 to 10.0 GPa), and a hardness range of 10.0 GPa or more. From the number of martensite grains classified in each class, the number proportion (number density) (%) of martensite grains having a hardness of 10.0 GPa or more and a ratio of the number N1 of martensite grains having a hardness of 8.0 GPa or more and less than 10.0 GPa to the number N2 of martensite grains having a hardness of less than 8.0 GPa were calculated. In Tables 5 to 10, ">10 GPa" represents the number proportion (%) of martensite grains having a hardness of 10.0 GPa or more. In addition, the number ratio N1/N2 represents the ratio of the number N1 of martensite grains having a hardness of 8.0 GPa or more and less than 10.0 GPa to the number N2 of martensite grains having a hardness of less than 8.0 GPa.

In the present example, the sample taken from the position away from the edge of the steel sheet in a sheet width direction by a quarter of a sheet width was dissolved in a predetermined amount of electrolytic solution by electrolysis. The total amount of the residue was recovered from the electrolytic solution. The weight of Ti in the residue was quantified by chemical analysis to determine the total weight of Ti in the precipitate. In addition, the total weight of nitrogen included in the dissolved steel sheet was calculated from the weight of the dissolved steel sheet and the mass % of nitrogen in the steel sheet, and the total weight of Ti in TiN was determined by multiplying the total weight of nitrogen by 48/14. The total weight of Ti in Ti carbide was obtained by subtracting the total weight of Ti in Ti nitride (TiN) from the total weight of Ti in the precipitate, and the mass % of Ti existing as Ti carbide was calculated from the total weight of Ti in the Ti carbide and the weight of the dissolved steel sheet.

In addition, a needle-shaped sample taken from a position away from the edge of the steel sheet in a sheet width direction by a quarter of a sheet width was analyzed by 3D-AP to obtain an element distribution image. Particles including Ti and C in a region of 10 μm×10 μm of the element distribution image were identified as Ti carbide and a circle equivalent grain sizes of Ti carbide having a circle equivalent grain size of 1 nm to 100 nm were measured. The measurement was performed on total 20 regions to obtain a particle size distribution of Ti carbide. The ratio of the total mass of Ti carbide having a circle equivalent grain size of 7 nm to 20 nm to the total mass of all Ti carbide was obtained.

The structure and mechanical properties of the steel sheet obtained by the above method were shown in Tables 5 to 10. In Tables 5 to 7, underlines are given to the columns that do not satisfy the essential conditions shown in the embodiments described above.

TABLE 5

| | Area ratio % | | | | Number proportion % | Number ratio | Ticar/ | Ratio of Ti carbide of | |
|---|---|---|---|---|---|---|---|---|---|
| No. | F | M | B | P | >10 GPa | N1/N2 | Tief % | 7 to 20 nm % | Note |
| A-1 | 92.4 | 7.1 | 0.5 | 0.0 | 8.3 | 1.1 | 57.4 | 43.0 | Invention Example |
| A-2 | 96.2 | 2.3 | 1.5 | 0.0 | 8.7 | 1.1 | 77.2 | 94.0 | Invention Example |
| A-3 | 83.0 | 5.1 | 11.9 | 0.0 | 9.2 | 1.1 | 21.0 | 89.8 | Comparative Example |
| A-4 | 91.8 | 7.3 | 0.9 | 0.0 | 8.9 | 1.0 | 44.0 | 13.0 | Invention Example |
| A-5 | 96.3 | 3.4 | 0.3 | 0.0 | 8.2 | 1.1 | 60.0 | 49.1 | Invention Example |
| A-6 | 94.1 | 5.6 | 0.3 | 0.0 | 7.5 | 1.0 | 51.9 | 39.8 | Invention Example |
| A-7 | 93.2 | 6.6 | 0.2 | 0.0 | 7.8 | 1.1 | 54.1 | 56.0 | Invention Example |
| A-8 | 35.8 | 7.2 | 57.0 | 0.0 | 8.6 | 1.0 | 55.1 | 60.0 | Comparative Example |
| A-9 | 93.2 | 6.7 | 0.1 | 0.0 | 9.0 | 0.6 | 65.0 | 58.9 | Comparative Example |
| A-10 | 93.8 | 5.2 | 1.0 | 0.0 | 9.0 | 0.5 | 62.8 | 50.0 | Comparative Example |
| A-11 | 94.7 | 4.4 | 0.9 | 0.0 | 8.5 | 0.5 | 69.8 | 58.0 | Comparative Example |

TABLE 5-continued

| No. | Area ratio % F | M | B | P | Number proportion % >10 GPa | Number ratio N1/N2 | Ticar/ Tief % | Ratio of Ti carbide of 7 to 20 nm % | Note |
|---|---|---|---|---|---|---|---|---|---|
| A-12 | 96.8 | 2.1 | 1.1 | 0.0 | 7.8 | 0.6 | 56.8 | 65.0 | Comparative Example |
| A-13 | 91.8 | 6.4 | 1.8 | 0.0 | 8.4 | 0.5 | 65.8 | 50.0 | Comparative Example |
| A-14 | 95.4 | 4.3 | 0.3 | 0.0 | 8.8 | 0.5 | 63.8 | 57.0 | Comparative Example |
| B-1 | 94.0 | 5.4 | 0.6 | 0.0 | 7.5 | 1.1 | 62.9 | 48.0 | Invention Example |
| B-2 | 87.5 | 11.7 | 0.8 | 0.0 | 9.6 | 1.0 | 49.8 | 46.0 | Comparative Example |
| B-3 | 91.7 | 7.7 | 0.6 | 0.0 | 8.5 | 0.9 | 59.8 | 70.0 | Invention Example |
| B-4 | 94.7 | 3.4 | 1.9 | 0.0 | 9.2 | 0.6 | 58.0 | 46.0 | Comparative Example |
| B-5 | 96.3 | 3.3 | 0.4 | 0.0 | 9.6 | 1.1 | 50.8 | 34.0 | Invention Example |
| B-6 | 93.1 | 6.4 | 0.5 | 0.0 | 8.4 | 1.1 | 65.5 | 66.0 | Invention Example |
| C-1 | 85.4 | 8.7 | 5.9 | 0.0 | 8.6 | 1.1 | 35.0 | 72.0 | Comparative Example |
| C-2 | 91.2 | 8.4 | 0.4 | 0.0 | 9.3 | 0.9 | 59.3 | 71.0 | Invention Example |
| C-3 | 95.3 | 4.5 | 0.2 | 0.0 | 8.8 | 1.0 | 54.1 | 62.9 | Invention Example |
| D-1 | 95.0 | 1.8 | 0.0 | 3.2 | 8.7 | 0.9 | 60.0 | 88.3 | Comparative Example |
| D-2 | 97.5 | 0.7 | 1.8 | 0.0 | 8.6 | 0.5 | 50.6 | 39.0 | Comparative Example |
| D-3 | 97.9 | 0.4 | 1.7 | 0.0 | 7.8 | 1.1 | 61.4 | 73.0 | Invention Example |
| E-1 | 96.7 | 1.5 | 1.8 | 0.0 | 7.5 | 1.0 | 62.5 | 42.0 | Invention Example |
| E-2 | 96.2 | 2.6 | 1.2 | 0.0 | 7.7 | 0.4 | 44.7 | 48.0 | Comparative Example |
| F-1 | 92.6 | 6.1 | 1.3 | 0.0 | 8.7 | 1.1 | 67.5 | 800 | Invention Example |
| G-1 | 92.0 | 6.9 | 1.1 | 0.0 | 8.7 | 0.9 | 51.1 | 63.8 | Invention Example |
| G-2 | 93.3 | 5.8 | 0.9 | 0.0 | 13.0 | 1.4 | 50.1 | 30.0 | Comparative Example |

TABLE 6

| No. | Area ratio % F | M | B | P | Number proportion % >10 GPa | Number ratio N1/N2 | Ticar/ Tief % | Ratio of Ti carbide of 7 to 20 nm % | Note |
|---|---|---|---|---|---|---|---|---|---|
| H-1 | 92.8 | 4.7 | 2.1 | 0.4 | 8.9 | 1.1 | 50.3 | 35.0 | Invention Example |
| H-2 | 96.3 | 3.0 | 0.7 | 0.0 | 7.9 | 1.1 | 60.6 | 82.3 | Invention Example |
| H-3 | 94.4 | 3.5 | 2.1 | 0.0 | 8.4 | 0.9 | 59.2 | 38.0 | Invention Example |
| H-4 | 94.0 | 4.8 | 1.2 | 0.0 | 8.3 | 1.0 | 46.9 | 45.0 | Invention Example |
| H-5 | 94.5 | 4.9 | 0.6 | 0.0 | 8.7 | 1.1 | 54.4 | 48.0 | Invention Example |
| H-6 | 97.0 | 2.8 | 0.2 | 0.0 | 8.3 | 1.0 | 52.8 | 73.3 | Invention Example |
| H-7 | 50.8 | 8.4 | 40.8 | 0.0 | 8.4 | 1.0 | 51.5 | 56.8 | Comparative Example |
| H-8 | 94.4 | 3.5 | 2.1 | 0.0 | 9.7 | 0.4 | 51.5 | 96.3 | Comparative Example |
| I-1 | 93.6 | 4.3 | 2.1 | 0.0 | 7.7 | 1.1 | 51.4 | 37.0 | Invention Example |
| I-2 | 95.8 | 2.1 | 2.1 | 0.0 | 7.7 | 1.0 | 52.7 | 45.0 | Invention Example |
| I-3 | 78.1 | 7.6 | 14.3 | 0.0 | 9.0 | 0.9 | 60.0 | 68.0 | Comparative Example |
| I-4 | 91.5 | 7.8 | 0.7 | 0.0 | 8.3 | 0.9 | 63.5 | 70.0 | Invention Example |
| I-5 | 92.2 | 7.6 | 0.2 | 0.0 | 8.4 | 0.5 | 48.4 | 46.0 | Comparative Example |
| I-6 | 95.7 | 4.3 | 0.0 | 0.0 | 9.7 | 1.0 | 58.3 | 79.0 | Invention Example |
| I-7 | 42.7 | 2.7 | 54.6 | 0.0 | 8.5 | 1.1 | 19.0 | 99.4 | Comparative Example |
| J-1 | 85.4 | 10.8 | 2.8 | 0.0 | 8.7 | 0.9 | 32.0 | 61.2 | Comparative Example |
| J-2 | 96.0 | 3.8 | 0.2 | 0.0 | 7.8 | 1.0 | 57.2 | 50.0 | Invention Example |
| J-3 | 96.2 | 2.8 | 1.0 | 0.0 | 9.5 | 1.0 | 63.8 | 82.0 | Invention Example |
| K-1 | 93.0 | 0.8 | 0.1 | 6.1 | 9.4 | 0.9 | 68.7 | 31.7 | Comparative Example |
| K-2 | 93.3 | 6.3 | 0.4 | 0.0 | 8.7 | 0.9 | 49.0 | 71.0 | Invention Example |
| K-3 | 91.2 | 7.6 | 1.2 | 0.0 | 8.6 | 0.6 | 65.9 | 75.0 | Comparative Example |
| L-1 | 96.4 | 2.9 | 0.7 | 0.0 | 8.0 | 1.1 | 53.5 | 42.0 | Invention Example |
| L-2 | 91.5 | 7.0 | 1.5 | 0.0 | 9.3 | 0.6 | 54.0 | 75.7 | Comparative Example |
| M-1 | 95.3 | 4.5 | 0.2 | 0.0 | 7.5 | 1.0 | 63.2 | 59.4 | Invention Example |
| N-1 | 97.0 | 2.0 | 1.0 | 0.0 | 9.1 | 1.0 | 58.9 | 65.9 | Invention Example |

TABLE 6-continued

| No. | Area ratio % F | M | B | P | Number proportion % >10 GPa | Number ratio N1/N2 | Ticar/ Tief % | Ratio of Ti carbide of 7 to 20 nm % | Note |
|---|---|---|---|---|---|---|---|---|---|
| N-2 | 92.7 | 7.0 | 0.3 | 0.0 | 11.2 | 1.4 | 65.9 | 78.3 | Comparative Example |
| O-1 | 97.6 | 2.4 | 0.0 | 0.0 | 9.1 | 0.9 | 60.2 | 22.0 | Invention Example |

TABLE 7

| No. | Area ratio % F | M | B | P | Number proportion % >10 GPa | Number ratio N1/N2 | Ticar/ Tief % | Ratio of Ti carbide of 7 to 20 nm % | Note |
|---|---|---|---|---|---|---|---|---|---|
| a-1 | 50.4 | 9.2 | 35.0 | 5.4 | 8.1 | 1.07 | 50.3 | 62.0 | Comparative Example |
| b-1 | 85.7 | 13.2 | 1.1 | 0.0 | 8.3 | 1.13 | 60.6 | 58.9 | Comparative Example |
| c-1 | 97.9 | 0.5 | 1.6 | 0.0 | 9.1 | 1.08 | 59.2 | 70.3 | Comparative Example |
| d-1 | 94.7 | 5.3 | 0.0 | 0.0 | 8.8 | 0.60 | 46.9 | 63.9 | Comparative Example |
| e-1 | 91.4 | 8.6 | 0.0 | 0.0 | 8.2 | 1.04 | 54.4 | 95.7 | Comparative Example |
| f-1 | 64.7 | 9.7 | 25.6 | 0.0 | 8.5 | 0.91 | 52.8 | 30.0 | Comparative Example |
| g-1 | 96.2 | 0.8 | 3.0 | 0.0 | 9.5 | 1.06 | 51.5 | 68.1 | Comparative Example |
| h-1 | 42.2 | 9.0 | 10.8 | 8.1 | 9.7 | 0.88 | 51.5 | 35.0 | Comparative Example |
| i-1 | 80.0 | 14.8 | 2.8 | 2.4 | 7.9 | 1.00 | 51.4 | 79.3 | Comparative Example |
| j-1 | 96.7 | 0.2 | 0.6 | 2.5 | 9.7 | 0.91 | 52.7 | 37.0 | Comparative Example |
| k-1 | 96.6 | 3.4 | 0.0 | 0.0 | 9.2 | 0.60 | 60.0 | 54.6 | Comparative Example |
| l-1 | 96.9 | 2.3 | 0.8 | 0.0 | 8.0 | 0.91 | 63.5 | 61.0 | Comparative Example |
| m-1 | 60.7 | 8.8 | 30.5 | 0.0 | 7.8 | 0.89 | 48.4 | 66.0 | Comparative Example |
| n-1 | 97.8 | 0.7 | 1.5 | 0.0 | 9.0 | 0.90 | 58.3 | 56.0 | Comparative Example |

TABLE 8

| No. | Mechanical properties YP MPa | TS MPa | El % | λ % | TS × El MPa % | TS × λ MPa % | c-YP MPa | (c-YP)/YP MPa | Note |
|---|---|---|---|---|---|---|---|---|---|
| A-1 | 514 | 605 | 26.0 | 119 | 15730 | 71995 | 453 | 0.88 | Invention Example |
| A-2 | 510 | 600 | 28.0 | 122 | 16800 | 73200 | 524 | 1.03 | Invention Example |
| A-3 | 542 | 638 | 23.2 | 112 | 14802 | 71456 | 484 | 0.89 | Comparative Example |
| A-4 | 525 | 618 | 26.7 | 117 | 16501 | 72306 | 441 | 0.84 | Invention Example |
| A-5 | 503 | 592 | 27.7 | 124 | 16398 | 73408 | 418 | 0.83 | Invention Example |
| A-6 | 494 | 581 | 27.6 | 125 | 16036 | 72625 | 395 | 0.80 | Invention Example |
| A-7 | 507 | 596 | 27.9 | 121 | 16628 | 72116 | 483 | 0.95 | Invention Example |
| A-8 | 487 | 573 | 26.0 | 127 | 14898 | 72771 | 447 | 0.92 | Comparative Example |
| A-9 | 448 | 527 | 32.2 | 138 | 16969 | 72726 | 415 | 0.93 | Comparative Example |
| A-10 | 451 | 530 | 30.0 | 136 | 15900 | 72080 | 412 | 0.92 | Comparative Example |
| A-11 | 463 | 545 | 29.6 | 130 | 16132 | 70850 | 450 | 0.97 | Comparative Example |
| A-12 | 468 | 551 | 30.1 | 131 | 16585 | 72181 | 447 | 0.96 | Comparative Example |
| A-13 | 462 | 543 | 30.4 | 135 | 16507 | 73305 | 442 | 0.96 | Comparative Example |
| A-14 | 466 | 548 | 30.7 | 133 | 16824 | 72884 | 449 | 0.96 | Comparative Example |
| B-1 | 511 | 601 | 28.2 | 122 | 16948 | 73322 | 450 | 0.88 | Invention Example |
| B-2 | 519 | 643 | 19.9 | 108 | 12796 | 69444 | 462 | 0.89 | Comparative Example |
| B-3 | 517 | 608 | 27.4 | 118 | 16659 | 71744 | 493 | 0.95 | Invention Example |
| B-4 | 466 | 548 | 28.6 | 134 | 15673 | 73432 | 391 | 0.84 | Comparative Example |
| B-5 | 505 | 594 | 28.9 | 122 | 17167 | 72468 | 444 | 0.88 | Invention Example |
| B-6 | 496 | 583 | 27.8 | 124 | 16207 | 72292 | 474 | 0.96 | Invention Example |
| C-1 | 483 | 568 | 26.5 | 125 | 15052 | 71000 | 430 | 0.89 | Comparative Example |
| C-2 | 485 | 571 | 28.5 | 126 | 16274 | 71946 | 473 | 0.97 | Invention Example |
| C-3 | 487 | 573 | 28.2 | 127 | 16159 | 72771 | 463 | 0.95 | Invention Example |
| D-1 | 516 | 586 | 28.9 | 91 | 16935 | 53326 | 507 | 0.98 | Comparative Example |

TABLE 8-continued

| No. | Mechanical properties YP MPa | TS MPa | El % | λ % | TS × El MPa % | TS × λ MPa % | c-YP MPa | (c-YP)/YP MPa | Note |
|---|---|---|---|---|---|---|---|---|---|
| D-2 | 537 | 568 | 29.9 | 127 | 16983 | 72136 | 430 | 0.80 | Comparative Example |
| D-3 | 570 | 622 | 27.1 | 113 | 16856 | 70286 | 558 | 0.98 | Invention Example |
| E-1 | 580 | 630 | 26.9 | 113 | 16947 | 71190 | 481 | 0.83 | Invention Example |
| E-2 | 516 | 607 | 27.1 | 120 | 16450 | 72840 | 454 | 0.88 | Comparative Example |
| F-1 | 551 | 648 | 25.0 | 112 | 16200 | 72576 | 526 | 0.96 | Invention Example |
| G-1 | 531 | 625 | 25.8 | 115 | 16125 | 71875 | 509 | 0.96 | Invention Example |
| G-2 | 564 | 663 | 25.2 | 103 | 16708 | 68289 | 479 | 0.85 | Comparative Example |

TABLE 9

| No. | Mechanical properties YP MPa | TS MPa | El % | λ % | TS × El MPa % | TS × λ MPa % | c-YP MPa | (c-YP)/YP MPa | Note |
|---|---|---|---|---|---|---|---|---|---|
| H-1 | 643 | 756 | 22.0 | 94 | 16632 | 71064 | 521 | 0.81 | Invention Example |
| H-2 | 648 | 762 | 23.2 | 93 | 17678 | 70866 | 627 | 0.97 | Invention Example |
| H-3 | 637 | 749 | 23.3 | 95 | 17452 | 71155 | 522 | 0.82 | Invention Example |
| H-4 | 642 | 755 | 23.0 | 98 | 17365 | 73990 | 545 | 0.85 | Invention Example |
| H-5 | 639 | 752 | 23.6 | 97 | 17747 | 72944 | 556 | 0.87 | Invention Example |
| H-6 | 647 | 761 | 23.3 | 96 | 17731 | 73056 | 607 | 0.94 | Invention Example |
| H-7 | 627 | 738 | 20.6 | 100 | 15203 | 73800 | 578 | 0.92 | Comparative Example |
| H-8 | 586 | 689 | 26.1 | 105 | 17983 | 72345 | 572 | 0.98 | Comparative Example |
| I-1 | 599 | 705 | 24.4 | 103 | 17202 | 72615 | 535 | 0.89 | Invention Example |
| I-2 | 609 | 716 | 24.5 | 101 | 17542 | 72316 | 536 | 0.88 | Invention Example |
| I-3 | 588 | 692 | 20.5 | 101 | 14186 | 69892 | 560 | 0.95 | Comparative Example |
| I-4 | 612 | 720 | 23.3 | 101 | 16776 | 72720 | 599 | 0.98 | Invention Example |
| I-5 | 547 | 643 | 26.5 | 111 | 17040 | 71373 | 459 | 0.84 | Comparative Example |
| I-6 | 581 | 683 | 25.5 | 107 | 17417 | 73081 | 552 | 0.95 | Invention Example |
| I-7 | 577 | 679 | 19.8 | 105 | 13444 | 71295 | 513 | 0.89 | Comparative Example |
| J-1 | 661 | 789 | 20.3 | 87 | 16017 | 68643 | 591 | 0.89 | Comparative Example |
| J-2 | 677 | 796 | 22.1 | 92 | 17592 | 73232 | 623 | 0.92 | Invention Example |
| J-3 | 664 | 781 | 21.9 | 92 | 17104 | 71852 | 632 | 0.95 | Invention Example |
| K-1 | 759 | 834 | 20.4 | 70 | 17014 | 58380 | 607 | 0.80 | Comparative Example |
| K-2 | 691 | 813 | 20.5 | 89 | 16667 | 72357 | 644 | 0.93 | Invention Example |
| K-3 | 625 | 735 | 23.7 | 100 | 17420 | 73500 | 604 | 0.97 | Comparative Example |
| L-1 | 683 | 803 | 21.1 | 89 | 16943 | 71467 | 560 | 0.82 | Invention Example |
| L-2 | 620 | 729 | 23.0 | 99 | 16767 | 72171 | 590 | 0.95 | Comparative Example |
| M-1 | 711 | 836 | 20.4 | 86 | 17054 | 71896 | 679 | 0.96 | Invention Example |
| N-1 | 751 | 883 | 20.1 | 84 | 17748 | 74172 | 697 | 0.93 | Invention Example |
| N-2 | 749 | 881 | 19.1 | 78 | 16827 | 68718 | 734 | 0.98 | Comparative Example |
| O-1 | 507 | 596 | 28.2 | 124 | 16807 | 73904 | 447 | 0.88 | Invention Example |

TABLE 10

| No. | Mechanical properties YP MPa | TS MPa | El % | λ % | TS × El MPa % | TS × λ MPa % | c-YP MPa | (c-YP)/YP MPa | Note |
|---|---|---|---|---|---|---|---|---|---|
| a-1 | 547 | 643 | 22.7 | 114 | 14596 | 73302 | 516 | 0.94 | Comparative Example |
| b-1 | 537 | 660 | 23.8 | 100 | 15708 | 66000 | 496 | 0.92 | Comparative Example |
| c-1 | 482 | 527 | 32.5 | 136 | 17128 | 71672 | 459 | 0.95 | Comparative Example |
| d-1 | 510 | 600 | 27.3 | 115 | 16380 | 69000 | 481 | 0.94 | Comparative Example |
| e-1 | 385 | 453 | 36.5 | 160 | 16535 | 72480 | 370 | 0.96 | Comparative Example |
| f-1 | 535 | 629 | 23.8 | 113 | 14970 | 71077 | 438 | 0.82 | Comparative Example |
| g-1 | 581 | 537 | 31.1 | 133 | 16701 | 71421 | 553 | 0.95 | Comparative Example |

TABLE 10-continued

| | Mechanical properties | | | | | | | | |
|---|---|---|---|---|---|---|---|---|---|
| No. | YP MPa | TS MPa | El % | λ % | TS × El MPa % | TS × λ MPa % | c-YP MPa | (c-YP)/YP MPa | Note |
| h-1 | 628 | 739 | 21.4 | 99 | 15815 | 73161 | 553 | 0.88 | Comparative Example |
| i-1 | 686 | 807 | 20.2 | 73 | 16301 | 58911 | 639 | 0.93 | Comparative Example |
| j-1 | 640 | 691 | 26.0 | 104 | 17966 | 71864 | 570 | 0.89 | Comparative Example |
| k-1 | 711 | 837 | 21.9 | 82 | 18330 | 68634 | 667 | 0.94 | Comparative Example |
| l-1 | 725 | 853 | 19.3 | 86 | 16463 | 73358 | 673 | 0.93 | Comparative Example |
| m-1 | 666 | 784 | 17.7 | 93 | 13877 | 72912 | 631 | 0.95 | Comparative Example |
| n-1 | 629 | 682 | 25.7 | 106 | 17527 | 72292 | 596 | 0.95 | Comparative Example |

The results will be described below.

The steel sheets of the Invention Example had excellent elongation and hole expansibility and high strength. In some Invention Examples, the secondary cooling starting temperature was 670° C. to 750° C. Therefore, a Ticar/Tief of the steel sheet was 40% or more and the ratio of Ti carbide of 7 to 20 nm to the entire Ti carbide was 50% or more. Therefore, the steel sheets of Invention Examples had not only excellent elongation and hole expansibility or high strength but also excellent fatigue strength.

In No. A-9 and No. H-8, since the finish rolling finishing temperature was lower than 850° C., the N1/N2 of the steel sheet was less than 0.8 and the strength was not sufficient.

In No. B-2 and No. I-3, since the finish rolling finishing temperature exceeded 1000° C., the area ratio of the ferrite in the steel sheet was less than 90% and the elongation was not sufficient.

In No. D-2 and No. K-3, since the primary cooling rate was slower than 20° C./s, the N1/N2 of the steel sheet was less than 0.8 and the strength was not sufficient.

In No. A-3 and No. I-7, since the secondary cooling starting temperature exceeded 750° C., the area ratio of the ferrite in the steel sheet was less than 90% and the elongation was not sufficient.

In No. A-8 and No. H-7, since the secondary cooling rate was faster than 10° C./s, the area ratio of the ferrite in the steel sheet was less than 90% and the elongation was not sufficient.

In No. C-1 and No. J-1, since the secondary cooling time was shorter than 2 seconds, the area ratio of the ferrite in the steel sheet was less than 90% and the elongation was not sufficient.

In No. D-1 and No. K-1, since the secondary cooling time was longer than 10 seconds, the area ratio of the pearlite in the steel sheet was more than 3% and the hole expansibility was not sufficient.

In Nos. A-10 to A-14, and No. B-4, and No. I-5, since the tertiary cooling rate was 80° C./s or slower, the N1/N2 of the steel sheet was less than 0.8 and the strength was not sufficient.

In No. E-2 and No. L-2, since the quaternary cooling rate was slower than 30° C./s, the N1/N2 of the steel sheet was less than 0.8 and the strength was not sufficient.

In No. G-2 and No. N-2, since the quaternary cooling rate was faster than 80° C./s, the number proportion of martensite grains having a hardness of 10.0 GPa or more was more than 10% and the hole expansibility was not sufficient.

In No. a-1 to n-1, since the chemical composition of the steel was not appropriate, at least one of strength, elongation, hole expansibility was not sufficient.

What is claimed is:

1. A hot-rolled steel sheet comprising, as a chemical composition, by mass %, C: 0.030% or more and less than 0.075%, Si+Al: 0.08% to 0.40%, Mn: 0.5% to 2.0%, Ti: 0.020% to 0.150%, Nb: 0% to 0.06%, Mo: 0% to 1.0%, V: 0% to 1.00%, W: 0% to 1.0%, B: 0% to 0.005%, Cu: 0% to 1.2%, Ni: 0% to 0.80%, Cr: 0% to 1.5%, Ca: 0% to 0.005%, REM: 0% to 0.050%, P: 0% to 0.040%, S: 0% to 0.0100%, N: 0% to 0.0100%, and a remainder comprising Fe and impurities, wherein the hot-rolled steel sheet includes a microstructure having ferrite and martensite, the microstructure contains 90% to 98% of ferrite, 2% to 10% of martensite, 0% to 3% of bainite, and 0% to 3% of a pearlite, by area %, in the martensite, a number proportion of martensite grains having a hardness of 10.0 GPa or more is 10% or less, and a ratio N1/N2 of a number N1 of martensite grains having a hardness of 8.0 GPa or more and less than 10.0 GPa to a number N2 of martensite grains having a hardness of less than 8.0 GPa is in a range from 0.8 to 1.2.

2. The hot-rolled steel sheet according to claim 1, comprising, as the chemical composition, by mass %, at least one selected from the group consisting of Nb: 0.005% to 0.06%, Mo: 0.05% to 1.0%, V: 0.02% to 1.0%, W: 0.1% to 1.0%, B: 0.0001% to 0.005%, Cu: 0.1% to 1.2%, Ni: 0.05% to 0.8%, Cr: 0.01% to 1.5%, Ca: 0.0005% to 0.0050%, and REM: 0.0005% to 0.0500%.

3. The hot-rolled steel sheet according to claim 1, wherein Ti existing as a Ti carbide is, by mass %, 40% or more of Tief calculated by Equation (1), $$Tief=(Ti)-48/14\times(N)-48/32\times(S) \quad (1),$$

where (Ti), (N), and (S) each represent a content, by mass %, of each corresponding element.

4. The hot-rolled steel sheet according to claim 3, wherein a ratio of a total mass of Ti carbide having a circle equivalent grain size of 7 nm to 20 nm to a total mass of all Ti carbides is 50% or more.

5. The hot-rolled steel sheet according to claim 2, wherein Ti existing as a Ti carbide is, by mass %, 40% or more of Tief calculated by Equation (1), $$Tief=(Ti)-48/14\times(N)-48/32\times(S) \quad (1),$$

where (Ti), (N), and (S) each represent a content, by mass %, of each corresponding element.

6. The hot-rolled steel sheet according to claim 5, wherein a ratio of a total mass of Ti carbide having a circle equivalent grain size of 7 nm to 20 nm to a total mass of all Ti carbides is 50% or more.

* * * * *